US006552304B1

(12) United States Patent
Hirose et al.

(10) Patent No.: US 6,552,304 B1
(45) **Date of Patent: *Apr. 22, 2003**

(54) TEMPERATURE CONTROL METHOD AND SYSTEM FOR THERMAL FIXING UNIT, AND IMAGE FORMING APPARATUS

(75) Inventors: Kazunori Hirose; Takashi Matsuya, both of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 631 days.

(21) Appl. No.: 09/207,269

(22) Filed: Dec. 8, 1998

(30) Foreign Application Priority Data

May 20, 1998 (JP) ..... 10-138292

(51) Int. Cl.[7] ..... H05B 1/00
(52) U.S. Cl. ..... 219/216; 399/69; 399/70
(58) Field of Search ..... 219/216; 399/69, 399/332, 70; 347/156

(56) References Cited

U.S. PATENT DOCUMENTS 4,551,007 A * 11/1985 Elter ..... 355/14 FU
4,825,242 A * 4/1989 Elter ..... 355/14
5,111,249 A * 5/1992 Owada ..... 355/285
5,280,328 A * 1/1994 Goto et al. ..... 355/285
5,289,247 A * 2/1994 Takano et al. ..... 355/285
5,621,511 A * 4/1997 Nakayama ..... 399/44
5,701,554 A * 12/1997 Takana et al. ..... 399/69
5,960,233 A * 9/1999 Goto et al. ..... 399/69

FOREIGN PATENT DOCUMENTS

| | | |
|---|---|---|
| JP | 57-14866 | 1/1982 |
| JP | 58-87574 | 5/1983 |
| JP | 3-163464 | 7/1991 |
| JP | 6-27855 | 2/1994 |
| JP | 8-185081 | 7/1996 |
| JP | 8-220929 | 8/1996 |

* cited by examiner

*Primary Examiner*—Teresa Walberg
*Assistant Examiner*—Shawntina Fuqua
(74) *Attorney, Agent, or Firm*—Armstrong, Westerman, Hattori, McLeland & Naughton, LLP

(57) ABSTRACT

Method and apparatus for controlling a temperature of a thermal fixing unit which is for the purpose of maintaining the balance between a fixing rate and the occurrence of wrinkles even if a distance between paper sheets greatly varies within a printer. When image formation is consecutively made onto a plurality of record mediums without stopping an operation of an image forming apparatus, an interval between the record mediums is detected, and a controlled target temperature for a thermal fixing unit is switched and set in accordance with the interval between the record mediums to control a heat source so that the temperature of the thermal fixing unit reaches the controlled target temperature. The image Corming apparatus may include an electrophotographic recording apparatus such as a copying machine, facsimile and laser printer using a toner.

15 Claims, 18 Drawing Sheets

TEMPERATURE CONTROL METHOD AND SYSTEM FOR THERMAL FIXING UNIT, AND IMAGE FORMING APPARATUS

BACKGROUND OF THE INVENTION

1) Field of the Invention

The present invention relates to a thermal fixing unit which is for use in an image forming apparatus including an electrophotographic recording apparatus such as a copying machine, facsimile and laser printer using a toner, and which thermally fixes an image transferred onto a record medium, and more particularly, relates to a method and system for controlling a temperature of the thermal fixing unit, and further to an image forming apparatus based upon that temperature control technique for the thermal fixing unit.

2) Description of the Related Art

In general, in an image forming apparatus (which will be referred hereinafter to as a printer) including an electrophotographic recording appartus such as a copying machine, a facsimile and a laser printer using a toner, a thermal fixing unit, which thermally fixes a toner image transferred onto a record medium (paper), is located along a record medium conveyance path on the downstream side of a transferring system.

FIG. 16 is an illustration of a common construction of the thermal fixing unit and a temperature control system therefor.

As shown in FIG. 16, a thermal fixing unit, designated at numeral 191, is made up of a heating roller 192 containing a heat source 193 such as a halogen lamp, and a pressure roller (backup roller) 194 for pressing a record medium against the heating roller 192.

In addition, a temperature measuring section 195 and a temperature control section 196 are provided as a temperature control system which takes charge of controlling a surface temperature of the heating roller 192. The temperature measuring section 195 is for measuring the surface temperature of the heating roller 192, and is constructed with a thermo-sensitive device such as a thermister, while the temperature control section 196 is for executing the ON (lights)/OFF (lights-out) -control for the heat source 193.

Secondly, referring to the flow chart (steps S1 to S8) of FIG. 17, a description will be made hereinbelow of a prior control operation in a printer including the aforesaid thermal fixing unit 191, and more specifically, of an operation to be taken for when an operational variation takes place from an ordinary printing operation to a Consecutive printing operation or a stand-by mode.

After the completion of a predetermined initializing operation, upon receipt of print data from a host unit such as a host computer, a printer starts to print the print data onto a paper sheet (record medium) (step S1). At this time, as will be described herein later, the surface temperature of the heating roller 192 in the thermal fixing unit 191 is controlled by the temperature control section 196 in accordance with various kinds of printing conditions or requirements, for example, whether or not the printer is in a consecutive printing operation and whether or not being in a starting operation (intermittent printing; the first printing to be done when the printing resumes from the stand-by mode).

After the completion of the printing of the print data from the host unit, in the case of receiving the next print data before a paper discharge sensor (not shown) detects a rear end portion of the paper sheet (YES route from step S2), the temperature control section 196 sets the desired temperature of the heating roller 192 to a target temperature to be controlled for consecutive printing which will be mentioned herein later (step S3), before a printing operation starts (step S1). Incidentally, the aforesaid paper discharge sensor is designed to sense the fact that the paper sheet rear end portion passes through the thermal fixing unit 191.

On the other hand, in the case that the reception of the next print data does not take place before the paper discharge sensor detects the paper sheet rear end portion (NO route from step S2), the temperature control section 196 gets the controlled target temperature for the beating roller 192 to a tempetature Tsb for a stand-by mode which will be mentioned herein later (step S4). Incidentally, in the step S4, in order to prevent the excessive heating resulting from the event that the pressure roller 194 comes into contact with the heating roller 192, the controlled target temperature by the heating roller 192 is merely set to the stand-by mode temperature Tsb lower than the controlled target temperature for the regular printing, which does not signify the actual advancement to the stand-by mode.

Following this, a decision is made as to whether the next print data is received or not (step S5), and a further decision is made on whether the time t elapsed after the paper sheet rear end portion passes by the paper discharge sensor of the thermal fixing unit 191 exceeds a predetermined time (for example, 5 seconds) (step S6).

If the reception of the next print data occurs before the time t exceeds 5 seconds (NO route from step S6 and YES route from step S5), the operational flow advances to the step S3 to continue the printing in a consecutive printing mode.

On the other hand, if no transmission of the next print data takes place although the time t exceeds 5 seconds (NO route of step S5 and YES route of step S6), the printer stops in accordance with a given stop sequence, and issues a stop command or the like to stop the rotation of its photosensitive drum (step S7) and then goes into the stand-by mode to wait for the next print data (print instruction) from the host unit (step S8).

Meanwhile, in case where the host unit such as a host computer makes a request for printing to a printer, the print data is evolved in the host unit or in a controller of the printer, and then transferred, together with a print instruction, from the controller to a mechanism control section within the printer. At this time, since the evolution or development time of the print data depends upon printing patterns, the evolution can be shorter or longer than the time required for the preceding printing (preceding print time).

In the case of accomplishing the printing of a plurality of identical patterns, or in the case that a print data evolution time is shorter than the preceding print time as mentioned above, for example as shown in FIG. 18A, the printer implements the consecutive printing while conveying paper sheets at its maximum print speed and at the minimum interval (distance) between the paper sheets. FIG. 18A is an illustration of an example of an output of a paper discharge sensor attainable when the printer conducts the consecutive printing while conveying the paper sheets at the maximum print speed and at the minimum interval.

On the other hand, if the next printing instruction (print data) does not arrive in the printer because of no completion of the evolution of the print data, although a predetermined time (for example, 5 seconds) elapses, as mentioned before with reference to FIG. 17, the printer stops the operations of the rotating system such as the photosensitive drum in accordance with a given stop sequence, and proceeds to the stand-by mode to go into the ready condition until receiving the next printing instruction. Thereafter, when the printing instruction comes, the printing is done in a predetermined printing start sequence. In an extreme example, in the case that a printing instruction comes immediately after a predetermined stand-by time elapses, after once stopping the printing in accordance with a stop sequence, the printer immediately resumes the printing through a restart sequence.

Furthermore, even in the case that the print data evolution time exceeds the preceding print time, for example as shown in FIG. 18B, the printer waits for the arrival of the next printing instruction by a predetermined time (for example, 5 seconds) after the completion of the preceding printing while operating the rotational drive system such as the rollers 192, 194 of the fixing unit 191, thereby surely suppressing the decrease in throughput. FIG. 18B is an illustration of an output of a paper discharge sensor when consecutive printing takes place in a state where the interval between paper sheets (inter-paper interval) vanes.

In the case of assuming a ready condition while operating the rotational drive system after the completion of the preceding printing as described above, as mentioned with the step S4 of FIG. 17, fot the purpose of avoiding even oxfly a little extra heating of the pressure roller 194, the controlled target temperature for the fixing unit 191 (the controlled target temperature for the heating roller 192) is switched to the stand-by mode temperature Tsb at the time that the paper sheet rear end portion passes by the paper discharge sensor. Since this stand-by mode temperature Tsb is naturally set to be lower than the controlled target temperature for the regular printing operation, the heat source 193 within the heating roller 192 is virtually cut off forcedly by the temperature control section 196. However, because the surface temperature of the heating roller 192 does not immediately drop even if the heat source 193 is cut off forcedly, the pressure roller 194 rotates while coining into contact with the heating roller 192 whose temperature is substantially kept at the controlled target temperature for the regular printing operation The controlled target temperature to be given during the consecutive printing is set to be higher than the controlled target temperature for the first printing (at the printing start) to be taken for when the printing resumes in response to the arrival of a printing instruction during the stand-by mode, and for the following reason or situation.

That is, since it takes a long time to warm up the pressure roller 194 at the start of printing, the fixing rate required is securable irrespective of a low temperature of the heating roller 192. Conversely, if the temperature of the heating roller 192 is not set to a relatively low value, an excessive fixing condition is liable to occur to produce wrinkles on paper sheets.

On the other hand, since the pressure roller 194 comes into contact with paper sheets for a longer time but coming into contact with the heating roller 192 for a shorter time during the consecutive printing, the temperature of the pressure roller 194 does not easily rise. Particularly, such a situation occurs noticeably in the case of performing the consecutive printing while conveying the paper sheets at the maximum print speed and at the minimum inter-paper interval (distance) as shown in FIG. 18A Accordingly, as mentioned above, the controlled target temperature to be taken during the consecutive printing is set to be higher than the controlled target temperature for the start of the printing.

However, when the inter-paper interval is prolonged halfway because of the problems about the data evolution time or the like even during the consecutive printing, since the pressure roller 194 is heated in a state of rotating while coming into contact with the heating roller 292 maintained substantially at the controlled target temperature for the regular printing operation as mentioned before, the temperature of the pressure roller 194 naturally tends to rise.

Meanwhile, in the recent years, as the pressure roller 194, there has been employed a roller made of a sponge (which will be referred hereinafter to as a sponge roller). The sponge roller is easier to warm up as compared with a prior toiler made of a rubber, and therefore, the employment of the spouse roller as the pressure roller 194 permits the temperature of the heating roller 192 to be set to a relatively low value. In addition, since the entire fixing unit also becomes easy to warm up, the shortening of the time period needed for the warming-up of the printer at the initial operation becomes feasible.

However, in the case that the aforesaid easy-to-warm sponge roller with a high thermal insulation effect is employed as the pressure roller 194, if the inter-paper interval is prolonged (varies) during the consecutive printing as shown in FIG. 18B, the temperature of the pressure roller 194 has a stronger tendency to rise.

The fixing conditions depend upon the temperature of the pressure roller 194 as well as the temperature of the heating roller 192, and hence, if the sponge roller is used as the pressure roller 194, the fixing is liable to go into an excessive condition. That is, the prolongation of the inter-paper interval destroys the balance between the fixing rate and the occurrence of wrinkles, which is excellent in a short inter-paper interval condition, so that wrinkles appear on the paper sheet after the fixing.

For instance, if the maximum paper sheet conveying speed is set to 83 mm/sec, even in the consecutive printing, the shortest inter-paper interval is at 39 mm while the longest inter-paper interval assumes 39+83×5=454 mm, the range therebetween becomes extremely wide. When the inter-paper interval approaches the longest, as mentioned previously, the temperature of the pressure roller 194 reaches a considerable high value. Nevertheless, in the case of the prior temperature control technique described with reference to FIG. 17, since, when print data arrives within 5 seconds after the passage of a paper sheet, the printing is implemented in a manner that the controlled target temperature for the heating roller 192 is set to the controlled target temperature to be taken during the consecutive printing, the next paper sheet is excessively heated by the heating roller 192 and the pressure roller 194. with the result that wrinkles appear on the paper sheet after the fixing.

Particularly, due to the recent progress of OA (Office Automation), there is a greater tendency for the print data evolution time to greatly vary because various types of data mixes on one page. Accordingly, the expectation exists that, even if the print data evolution time thus greatly varies, that is, even if the inter-paper interval within the printer greatly varies the occurrence of wrinkles on paper sheets after the fixing is certainly preventable to enhance the print quality.

In addition, in recent years, in general, there is an environmental tendency for a plurality of users to make a request, to printers connected to a network, for various kinds of printing processing at an arbitrary time. Accordingly, the expectation in the thermal fixing also exists that, even under such an environment, the maintenance of the print quality and the prevention of the decrease in throughput are achievable to improve the performance of an information processing system.

SUMMARY OF THE INVENTION

The present invention has been developed with a view to eliminating these problems, and it is therefore an object of this invention to provide a temperature control method and system for a thermal fixing unit and an image forming apparatus which arc capable of adjusting the balance between the fixing rate and the occurrence of wrinkles irrespective of a great variation of an interval between paper sheets within a printer to surety prevent the occurrence of wrinkles on paper sheets after the fixing so that the print quality is improbable.

For this purpose, in accordance with this invention, there is provided a thermal fixing unit temperature control method of controlling a temperature of a thermal fixing unit which is equipped with a heating roller containing a heat source and a pressure roller for pressing a record medium against the heating roller to thermally fix an image transferred onto the record medium in an image forming apparatus. the temperature control method comprising the steps of, when image formation is consecutively effected onto a plurality of record mediums without stopping the image forming apparatus, detecting an interval between the plurality of record mediums, switching and setting a controlled target temperature for the thermal fixing unit in accordance with the interval between the record mediums, and controlling the heat source so that the temperature of the thermal fixing unit reaches the controlled target temperature.

In addition, in accordance with this invention, there is provided a temperature control system for controlling a temperature of a thermal fixing unit including a heating roller containing a heat source and a pressure roller for pressing a record medium against the heating roller to thermally fix an image transferred onto the record medium in an image forming apparatus, the temperature control system comprising an interval detecting section for, when an image formation is consecutively effected onto a plurality of record mediums without stopping an operation of the image forming apparatus, detecting an interval between the plurality of record mediums, a controlled target temperature switching and setting section for switching and setting a controlled target temperature for the thermal fixing unit in accordance with the interval between the record mediums detected by the interval detecting section, a temperature detecting section for detecting a temperature of the thermal fixing unit, and a temperature control section for controlling the heat source so that the detection result by the temperature detecting section coincides with the controlled target temperature set by the controlled target temperature switching and setting section.

Furthermore, in accordance with this invention, there is provided an image forming apparatus comprising an image forming section for transferring and forming an image on a record medium, a thermal fixing unit including a heating roller containing a heat source and a pressure roller for pressing the record medium against the heating toiler to thermally fix the image transferred by the image forming section on the record medium, an interval detecting section for, when an image formation is consecutively effected onto a plurality of record mediums without stopping the image forming section, detecting an interval between the plurality of record mediums, a controlled target temperatare switching and setting section for switching and setting a controlled target temperatnre for the thermal fixing unit in accordance with the interval between the record mediums detected by the interval detecting section, a temperature detecting section for detecting a temperature of the thermal fixing unit, and a temperature control section for controlling the heat source so that the detection result by the temperature detecting sectioa coincides with the controlled target temperature set by the controlled target temperature switching and setting section.

Thus, in the thermal fixing unit temperature control method and system and the image forming apparatus according to this invention, since the controlled target temperature is switched and set in accordance with the interval between the recotd mediums, even if the interval between the record mediums greatly varies within the image forming apparatus, it is possible to certainly suppress the occurrence of a problem in that the pressure roller is excessively heated by the heating roller to produce excessive fixing, which allows the balance between the fixing rate and the occurrence of wrinkles to be suitably adjustable, thus surely preventing the occurrence of wrinkles on paper sheets after the fixing to noticeably enhance the print quality.

DESCRIPTION OF THE PREFERRED EMBODIMENTS

[A] Description of an Aspect of this Invention

Figure 1:
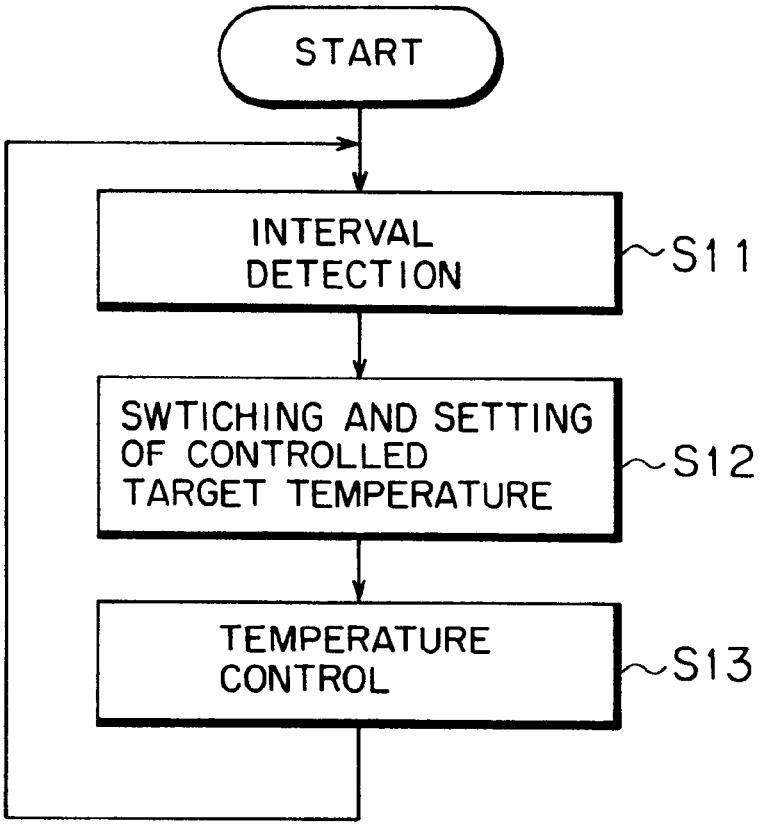
FIG. 1 is an illustration useful for describing an aspect of a temperature control method for a thermal fixing unit according to the present invention.

FIG. 1 is an illustration useful for describing an aspect of a temperature control method for a thermal fixing unit according to the present invention. As shown in FIG. 1, the thermal fixing unit temperature control method according to this invention is for controlling a temperature of a thermal fixing unit including a heating roller containing a heat source and a pressure roller for pressing a record medium against the heating roller to thermally fix an image transferred onto the record medium in an image forming apparatus, and comprises the steps of detecting an interval between record mediums (record medium interval) in case where consecutive image formation is done onto a plurality of record mediums without stopping an operation of the image forming apparatus (step S11), switching and setting a target temperature to be controlled (controlled target temperature) for the thermal fixing unit in accordance with the record medium interval (step S12), and controlling the heat source so that the temperature of the thermal fixing unit becomes equal to the controlled target temperature (step S13).

In the step S12, when the record medium interval is greater than a predetermined value, the controlled target temperature for the thermal fixing unit can also be switched and set to be lower than a controlled target temperature preset for a consecutive image formation. In this case, that controlled target temperature can be the controlled target temperature preset for the start of printing.

Furthermore, in the step S11, the record medium interval is detected as an arrival time interval of image formation data at a mechanism control section within the image forming apparatus, and in the step S12, when the arrival time interval detected exceeds a time interval corresponding to the aforesaid predetermined value, a decision can be made to that the record medium interval becomes longer than the aforesaid predetermined value so that the switching and setting of the controlled target temperature for the thermal fixing unit are done.

Figure 2:
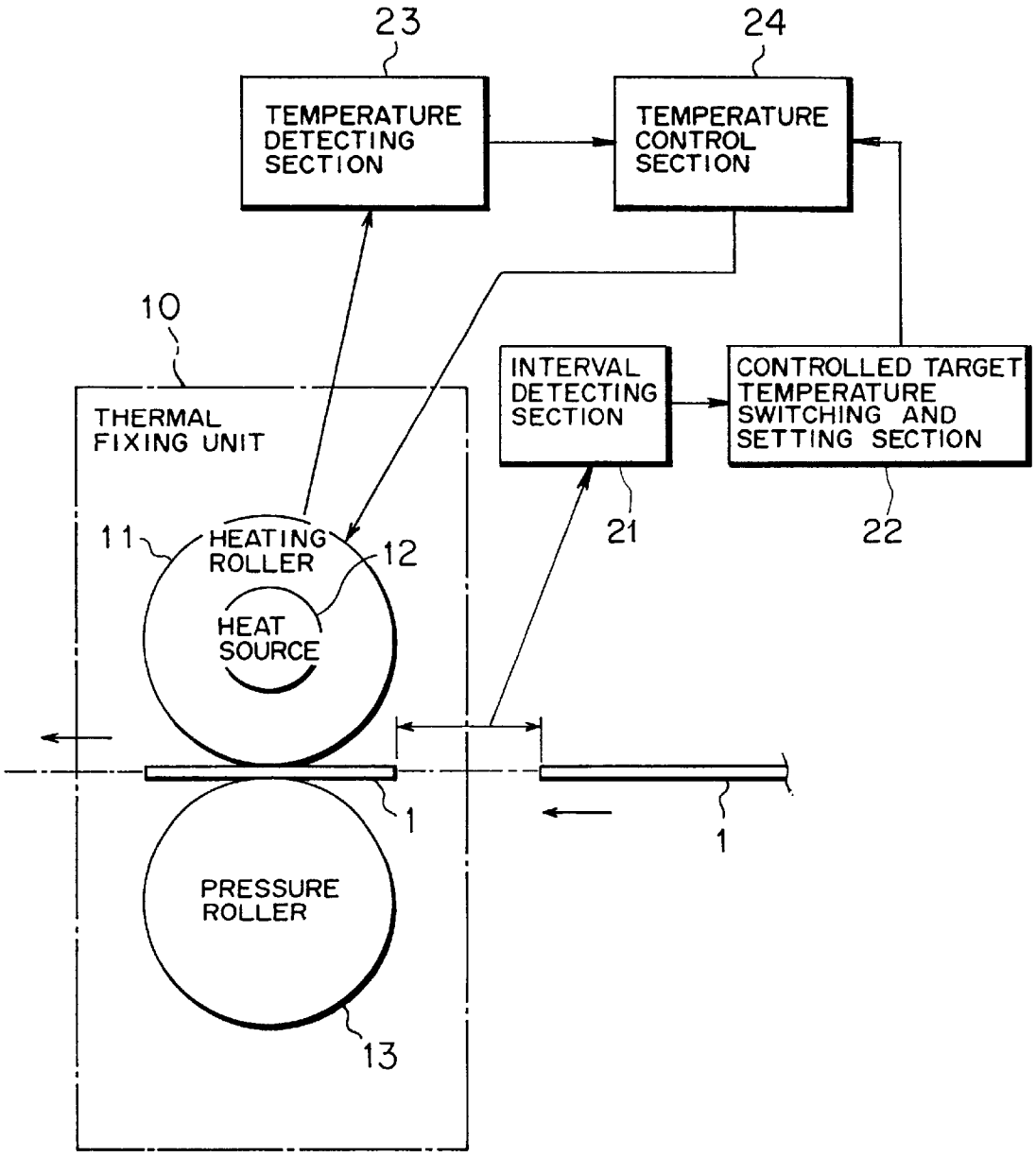
FIG. 2 is a block diagram showing an aspect of a temperature control system for a thermal fixing unit according to this invention.

FIG. 2 is a block diagram showing one aspect of a temperature control system for a thermal fixing unit according to this invention. As shown in FIG. 2, the temperature control system for a thermal fixing unit according to this invention is for controlling a temperature of a thermal fixing unit 10 comprising a heating roller 11 having a heat source 12 therein and a pressure roller 13 for pressing a record medium 1 against the heating roller 11 to thermally fix an image transferred onto the record medium 1 in an image forming apparatus, and is composed of an interval detecting section 21, a controlled target temperature switching and setting section 22, a temperature detecting section 23 and a temperature control section 24.

In this arrangement, in the case that image formation is consecutively performed with respect to a plurality of record mediums without stopping the operation of the image forming apparatus, the interval detecting section 21 detects the interval between the record mediums 1. The controlled target temperature switching and setting section 22 switches and sets the controlled target temperature for the thermal fixing unit 10 in accordance with the record medium interval detected by the interval detecting section 21. The temperature detecting section 23 detects the temperature of the thermal fixing unit The temperature control section 24 controls the heat source 12 so that the detection result by the temperature detecting section 23 reaches the controlled target temperature set by the controlled target temperature switching and setting section 22.

Figure 3:
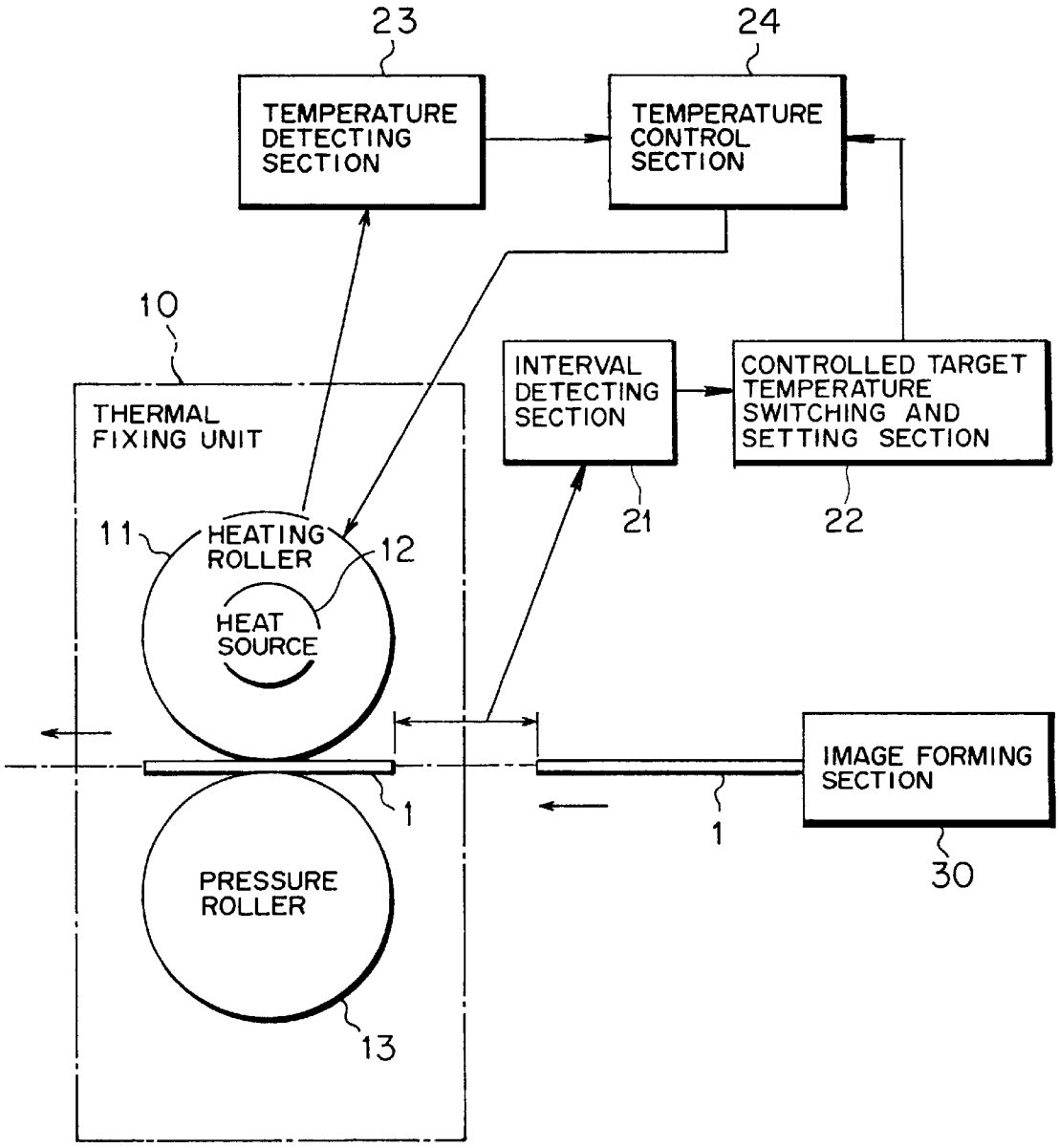
FIG. 3 is a block diagram showing an aspect of an image forming apparatus according to this invention.

Besides, FIG. 3 is a block diagram showing an aspect of an image forming apparatus according to this invention. As shown in FIG. 3, the image forming apparatus according to this invention is made up of, in addition to an image forming section 30 for transferring an image onto a record medium 1 for image formation, a thermal fixing unit 10 having the same construction as that shown in FIG. 1 for thermally fixing the image transferred by the image forming section 30 onto the record medium 1, the interval detecting section 21, the controlled target temperature switching and setting section 22, the temperature detecting section 23 and the temperature control section 24 which have been mentioned with reference to FIGS. 1 and 2.

In the image forming apparatus thus constructed, the controlled target temperature switching and setting section 22, when the interval between the record mediums 1 is larger than a predetermined value, can switch and set the controlled target temperature for the thermal fixing unit 10 to a value lower than the controlled target temperature preset for the consecutive image formation. In this case, that controlled target temperature can be the controlled target temperature preset for the start of printing.

Furthermore, the interval detecting section 21 can be constructed as means to detect the interval between the record mediums 1 as the arrival time interval of image formation data, while the controlled target temperature switching and setting section 22 can make a decision to that the interval between the record mediums 1 exceeds the aforesaid predetermined value when the arrival time interval detected by the interval detecting section 21 exceeds a time interval corresponding to the aforesaid predetermined value, and conduct the switching and setting of the controlled target temperature for the thermal fixing unit 10.

In the above-described thermal fixing unit temperature control method and system and image forming apparatus according to this invention, in case where image formation is consecutively made onto a plurality of record mediums 1 without stopping the operation of the image forming apparatus (image forming section 30), when the interval between the record mediums 1 varies, the interval detecting section 21 detects that interval after the variation, and the controlled target temperature switching and setting section 22 switches and sets the controlled target temperature for the thermal fixing unit 10 in accordance with the detected interval, and further, the temperature control section 24 controls, through the temperature detecting section 23, the temperature of the thermal fixing unit 10 to the set controlled target temperature.

That is, as mentioned above, when the interval between the record mediums 1 exceeds a predetermined value, the controlled target temperature for the thermal fixing unit 10 is switched to be lower than a preset controlled target temperature for the consecutive image formation, with the result that it is possible to suppress the occurrence of excessive fixing resulting from the excessive heating of the pressure roller 13 by the heating roller 11. Accordingly, the balance between fixing rate and the occurrence of wrinkles is maintainable irrespective of the large variation of the distance between paper sheets within the printer.

Furthermore, when the interval between the record mediums 1 exceeds the predetermined value, if the printing start controlled target temperature set in advance to be lower than the consecutive image formation controlled target temperature is employed as the controlled target temperature for the thermal fixing unit 10, there is no need to separately set the controlled target temperature at the variation of the interval between the record mediums 1.

Besides, since the detection of the arrival time interval of image formation data is made for the detection of the interval between the record mediums 1 the record medium 1 is easily obtainable without relying upon the actual measurement.

As described above, in the thermal fixing unit temperature control method and system and image forming apparatus according to this invention, the switching and setting of the controlled target temperature for the thermal fixing unit 10 are made in accordance with the interval between the record mediums 1 so that the occurrence of excessive fixing resulting from the excessive heating of the pressure roller 13 by the heating roller 11 is certainly suppressible even if the interval between the record mediums (paper sheets) 1 greatly varies within the image forming apparatus (printer), and therefore, the balance between the fixing rate and the occurrence of wrinkles is maintainable, thus surely preventing the occurrence of wrinkles on the paper sheets after the fixing to considerably improve the print quality.

Particularly, although, with the recent progress of OA, there is a greater tendency for the print data evolution time to greatly vary because various types of data exist in a mixed condition on one page, as mentioned before, this invention can surely prevent the occurrence of wrinkles on paper sheets after fixing and remarkably improve the print quality even if the print data evolution time greatly varies, that is, the distance between the paper sheets largely varies within the printer.

In addition, although, in the recent years, an environment in which a plurality of users make a request, to printers connected to a network, for various kinds of printing processing at an arbitrary time comes into a popularization, even under such an environment, this invention can achieve the thermal fixing while maintaining the print quality without causing the decrease in throughput, thus sharply improving the performance of an information processing system.

[B] Description of Embodiment of the Invention

Embodiments of the present invention will be described hereinbelow with reference to the drawings.

Figure 4:
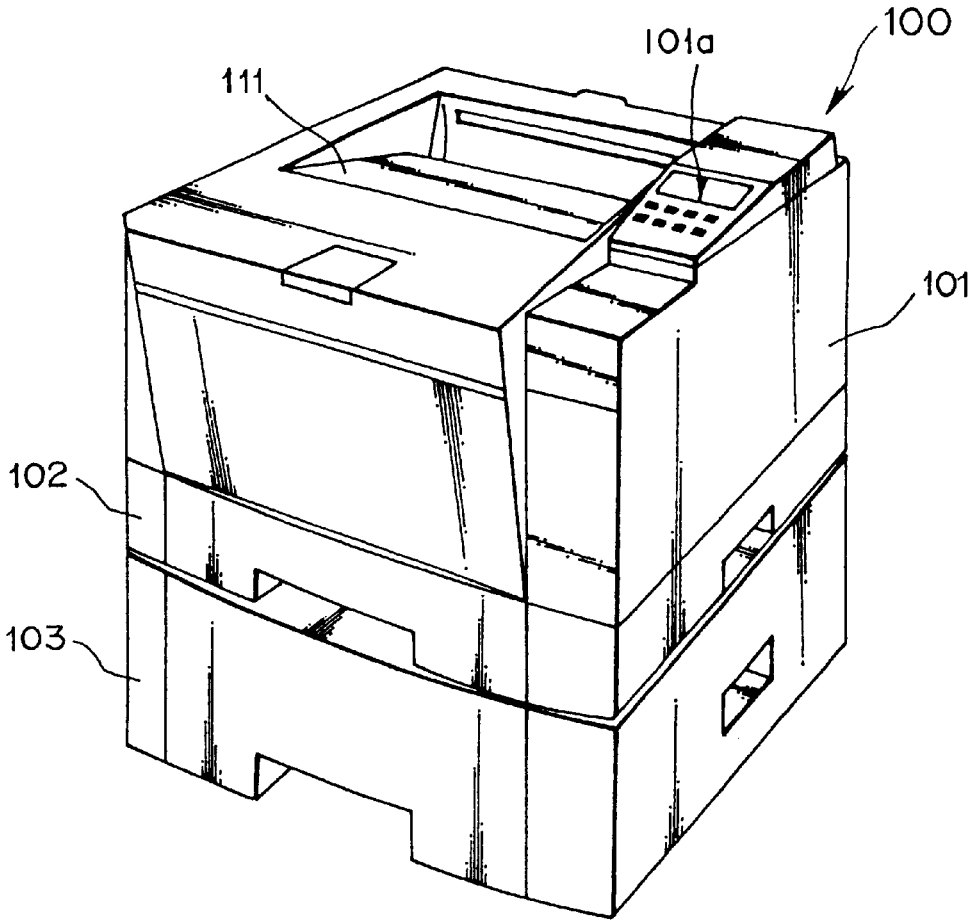
FIG. 4 is a perspective view showing an appearance of a printer (image forming apparatus) according to an embodiment of this invention.

FIG. 4 is a perspective view showing an appearance of an electrophotographic printer (laser printer; image forming apparatus) 100 according to an embodiment of this invention, which is, as shown in FIG. 4, made up of a printer body 101 for taking charge of image formation and a paper feeding unit (a double-face printing unit 102 and a first paper feeding unit 103) for feeding paper sheets (record mediums; see reference numeral 1 in FIGS. 2 and 3) to the printer body 101.

The printer body 101 internally contains various units for image formation and medium conveying system which will be described herein later with reference to FIG. 5, and further, is, thereabove, provided with a stacker 111 for receiving and holding paper sheets discharged after printing and an operator control panel 101a the user operates. The operator control panel 101a has buttons to be used for conducting various setting and information inputting for the printer 100 and a display for displaying the operating conditions and set conditions of the printer 100, with the display also serving as a touch panel.

The paper feeding unit is optionally mounted on the printer 100 by the user when necessary, and in the example shown in FIG. 4, as the paper feeding unit, there are mounted a double-face printing unit 102 and a first paper feeding unit 103 for accommodating paper sheets in a stacking or accumulating manner. Although the double-face printing unit 102 can function as a paper feeding unit for storing paper sheets in a stacking manner, in this embodiment, it serves as a mechanism to turn over the paper sheet and then to feed it to the printer body iQI for the double double-face printing which further conducts the printing on the rear surface of the paper sheet, If paper sheets different in size and type from each other are stored in these paper feeding units 102, 103 in accordance with applications, the printer 100 can widely meet the printing requirements from the printer users without replacing the paper sheet within the paper feeding units on all such occasions. Besides, it is also possible to additionally set a paper feeding unit(s) under the first paper feeding unit 103.

Secondly, referring to FIG. 5, a description will be given hereinbelow of an internal construction of the printer 100 according to this embodiment.

Figure 5:
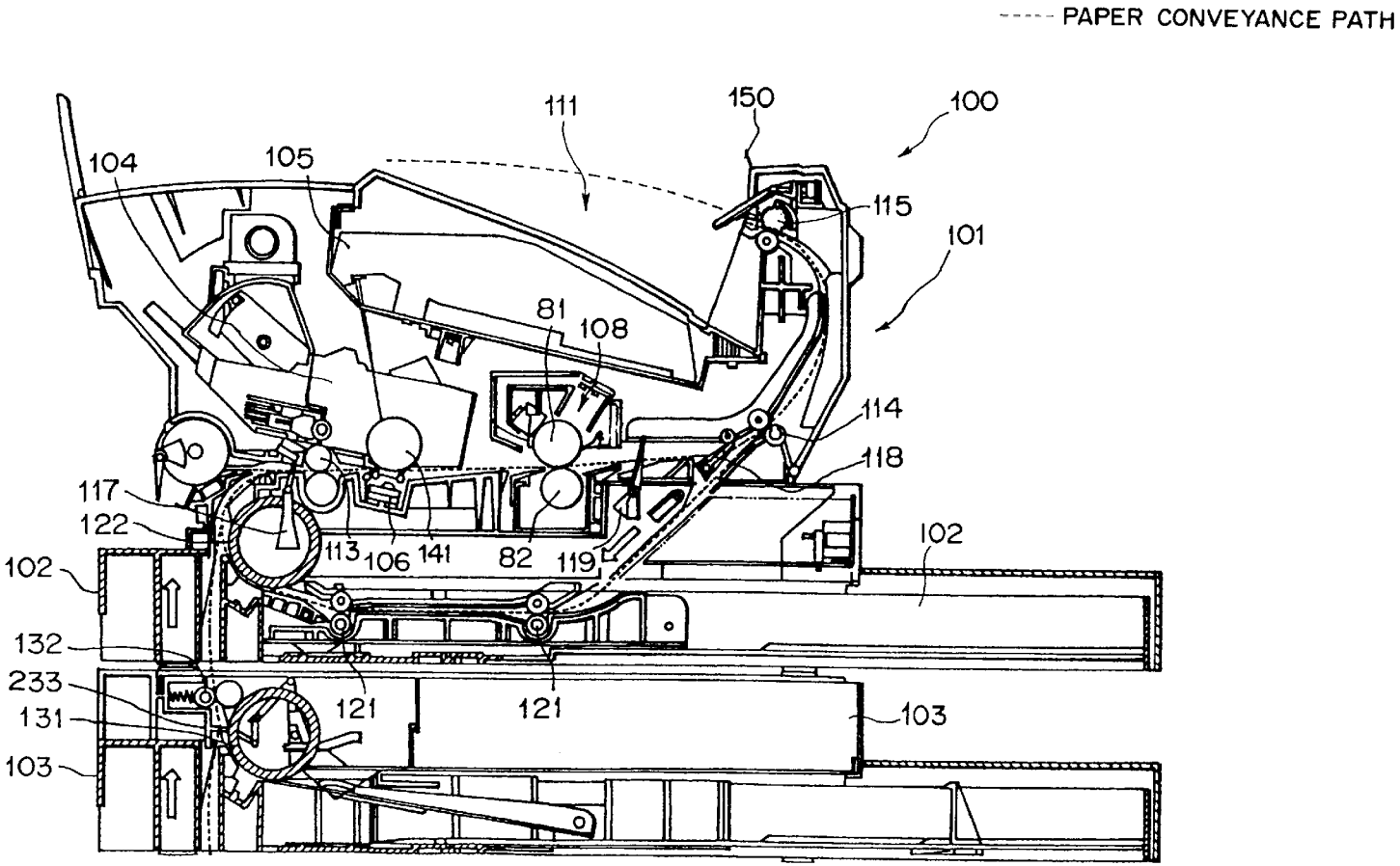
FIG. 5 is a side-elevational and cross-sectional view showing an internal structure of the printer according to this embodiment.

As shown in FIG. 5, on the paper discharging side of the first paper feeding unit 103, there are provided a pickup roller 131 for one by one drawing out the paper sheet accumulated in the first paper feeding unit 103 and a feed roller 132 for upwardly transferring the paper sheet drawn out from the pickup roller 131. Although the paper feeding unit 103 is further equipped with a paper size sensor 231, a paper feeding motor 232 and a paper feed sensor 233 as will be described herein later with reference to FIG. 6, of these components only the paper feed sensor 233 for detecting the paper sheet drawn out from the paper feeding unit 103 is illustrated in FIG. 5.

Furthermore, the double-face printing unit 102 is provided with two pairs of double-face feeding rollers 121 for conveying the paper sheet while holding it therebetween to turn over the paper sheet and then to supply it to the printer body 101 at the double-face printing. On the printer body 101 side, there is provided a pickup roller 122 for delivering the turned-over paper sheet from the double-face printing unit 102 to the interior of the printer body 101.

Still further, the printer body 101 internally includes resist rollers 113, a developing unit (printing unit) 104, an optical unit 105, a transfer unit 106, a fixing unit (which is sometimes referred to as a thermal fixing unit) 108, a first paper discharging roller 114, a second paper discharging roller 115, a resist sensor 117, a flap gate 118, a paper passage sensor 119, a paper discharge sensor 150 and other components. Besides, as will be described herein later with reference to FIG. 6, the printer body 101 further contains a controller 110, a mechanism control section 112 and a power supply section 134.

Figure 6:
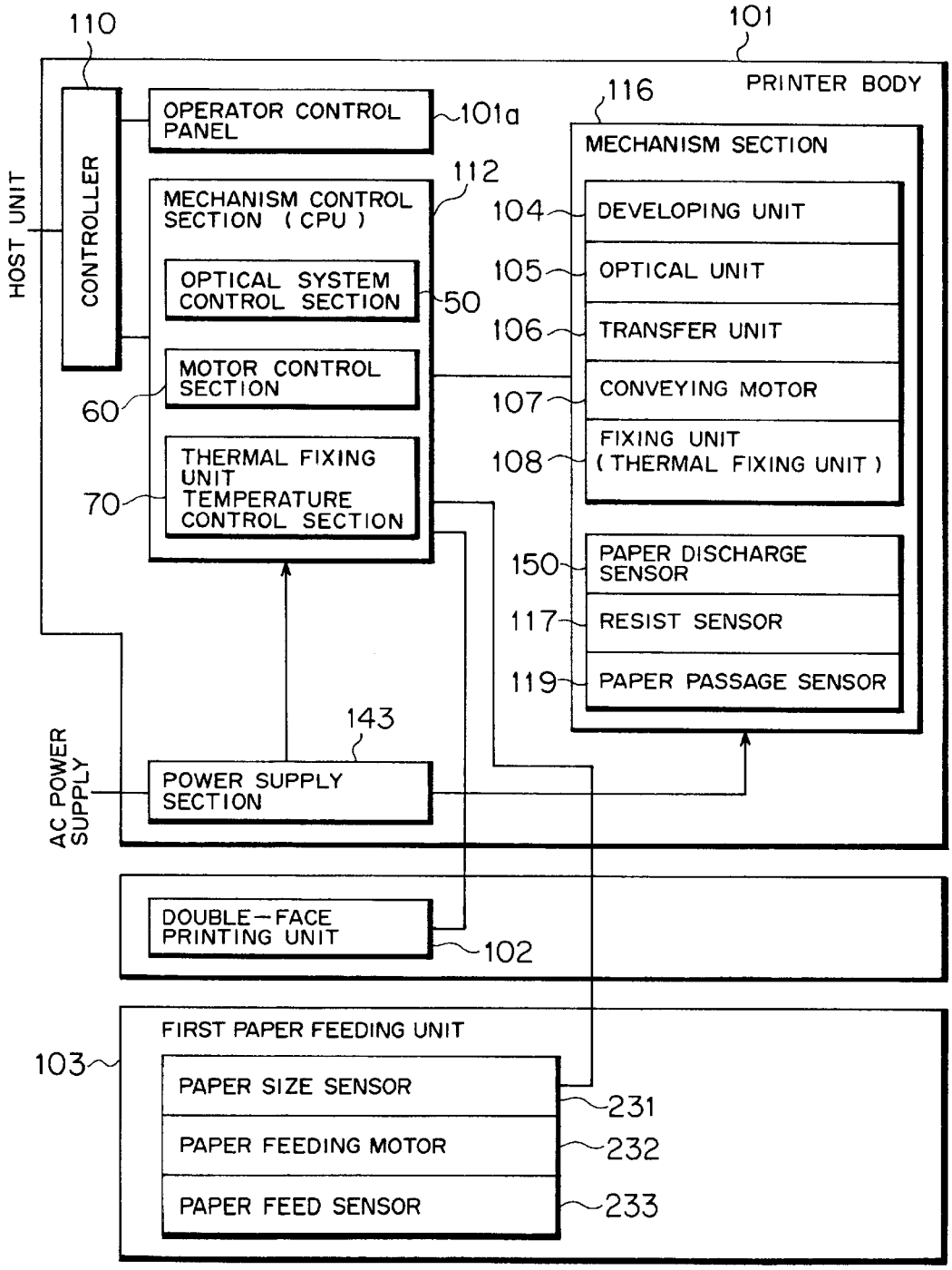
FIG. 6 is a block diagram showing an arrangement of a control system in the printer according to this embodiment.

The resist toilers 113 are paired to hold and convey the paper sheet fed from the first paper feeding unit 103 or the double-face printing unit 102, and rotationally driven by a conveying motor 107 (see FIG. 6). On the upstream side of the resist rollers 113, there is placed the resist sensor 117 which detects the arrival of the tip portion of the paper sheet at the vicinity of the holding position of the resist rollers 113.

The developing unit 104 includes, in addition to a photosensitive drum 141, although not shown in the illustration, a developing device, a cleaner section, an electrification eliminating device, a charging (electrifying) device and other components which are together accommodated as a unit in one housing to allow simultaneous replacement.

The photosensitive drum 141 is for forming an Image, which should be transferred onto the paper sheet in a later process, on its own surface with the aid of the charging device, the optical unit 105 and the developing device while being rotationally driven at a constant speed by a non-shown drive motor. That is, the charging device evenly charges the surface of the photosensitive drum 141, and the optical unit 105 exposes the charged surface of the photosensitive drum 141 to produce a latent image on the same surface, and further, the developing device develops the latent image on the photosensitive drum 141 to form a visible image (toner image) thereon. Incidentally, in this embodiment, the motor for rotationally driving the photosensitive drum 141 is designed to further rotationally drive rollers 81, 82 of the fixing unit 108, thus accomplishing the decrease in system cost.

The transfer unit 106 is for transferring a toner image formed on the surface of the photosensitive drum 141 onto the paper sheet, and is disposed in an opposed relation to the photosensitive drum 141 in a state of being at a position separated from the photosensitive drum 141 to define a gap or separation allowing the paper sheet to pass so that a paper conveyance path exists therebetween. Further, for the control of the transfer unit 106, the power supply therefor turns on at the time that the paper sheet conveyed by the resist rollers 113 reaches the transferring position so that the transfer unit 106 goes into a transferring condition.

As the transfer unit 106, Mr example, there is employed a well-known transferring device using a wire. In such a transferring device, for transferring a toner image from the photosensitive drum 141 onto the paper sheet, when the paper sheet arrives at the transferring position, a voltage is applied to the wire so that the toner image on the surface of the photosensitive drum 141 is sucked from the side of the surface opposite to the print surface of the paper sheet toward the print surface of the paper sheet to be attached thereonto. Since the voltage to be applied to the wire of the transferring device is a voltage as high as thousands of volts, if the power supply for the transferring device turns on at an early stage, there occur problems in that the power consumption increases when the power-on period is long and the transfer efficiency lowers because the residual developer on the surface of the photosensitive drum 141 is sucked to the wire of the transferring device. For this reason, in the transfer unit, it is desirable to apply a voltage only during the transferring period to the paper sheet.

As another transferring method using a transferring device, there has been known a roller transferring method in which a voltage is applied to a roller using a conductive rubber and a paper sheet is held between the roller and a photosensitive drum (141) under pressure to transfer a toner image on the surface of the photosensitive drum onto the paper sheet as also disclosed in Japanese Unexamined Patent Publication No. 5-346751 (Japanese Patent Application No. 4-156805).

On the downstream side of the aforesaid transfer unit 106, there is provided the thermal fixing unit 108 for fixing a toner image transferred onto the paper sheet in the transfer unit 106. This thermal fixing unit 108 is made up of a heating roller 81 and a pressure roller 82.

The heating roller 81 internally includes a heat source 83 (see FIG. 7) such as a halogen lamp, and is rotationally driven by a non-shown drive motor (identical with that fat driving the photosensitive drum 141). For exampie, this heating roller 81 is of a tube configuration and is made of aluminium or the like.

The pressure roller 82 is constructed so that both end portions of its rotary shaft are supported by an elastic member (not shown) such as a coil spring, and owing its elastic force (biasing force), the paper sheet (record medium) passing between the heating toiler 81 and the pressure roller 82 is pressed by a given force against the heating roller 81. This pressure roller 82, being made from a rubber, a sponge or the like, is constructed as a driven roller which rotates with the rotation of the heating roller 81. but does not include a heat source.

Furtherinore, the heating roller 81 is disposed to come into contact with the print surface side of the paper sheet, and the surface temperature of the pressure roller 82 is brought close to the surface temperature of the heating roller 81 by the heat coming from the heating roller 81, and the toner is also heated from the rear surface side of the paper sheet, thus enhancing the toner fixing efficiency. The widths of the heating roller 81 and the pressure roller 82 are set to be larger than the paper sizes. i.e., the widths in the conveying direction for example, 297 mm in A3 size (one finished paper size according to Japanese Standard Specification)) of the paper sheet treatable in the printer 100 according to this embodiment. When the heat and pressure are given to the paper sheet held between the heating roller 81 and pressure roller 82 mentioned above, the toner on the paper sheet is softened so that the toner image is fixed onto the paper sheet.

On the downstream side of the aforesaid thermal fixing unit 108, there are provided first and second paper discharging rollers 114, 115 for holding and conveying the paper sheet after the completion of printing to discharge it toward a stacker 111, and further provided the flap gate 118 and the paper passage sensor 119. Although the first paper discharging roller 114 and the second paper discharging roller 115 are rotationally driven by a non-shown motor in a direction of conveying the paper sheet toward the stacker 111 in the regular condition, in the case that the paper sheet is fed into the double-face printing unit 102 to be turned over for the double-face printing, they are reversely driven.

The flap gate 118 is usually biased by a non-shown spring to close the conveying path from the thermal fixing unit 108 to the stacker 111, and is removed from the conveying path by the paper sheet sent out from the thermal fixing unit 108 to permit the passage of the paper sheet frorn the thermal fixing unit 108 and, after the passage of the teat end portion of the paper sheet, is returned by the biasing force of the spring up to the position at which it closes the conveying path from the thermal fixing unit 108 to the stacker 111. When the paper sheet is fed into the double-face printing unit 102 for the double-face printing, this flap gate also fulfills a function to select the paper sheet conveying direction to prevent the paper sheet from returning to the thermal fixing unit 108 side.

The paper passage sensor 119 is put between the thermal fixing unit 108 and the flap gate 118 for detecting the passage of the rear end portion of the paper sheet, and the mechanism control section 112 (see FIG. 6) uses the detection result by this paper passage sensor 119 for recognizing the fact that the rear end portion of the paper sheet passes by the flap gate 118. That is, the mechanism control section 112 is made to recognize the passage of the rear end portion of the paper sheer by the flap gate 118 in a manner that the paper sheet is conveyed by a predetermined distance (a value determined by actually conveying the paper sheet in an experimental stage) after the detection of the rear end portion of the paper sheet by the paper passage sensor 119.

Besides, in this embodiment, the feed roller 132, the double-face feed roller 121, the pickup roller 122, the resist rollers 113, the heating roller 81, the pressure roller 82, the first paper discharging roller 114 and the second paper discharging roller 115 function as a medium conveyance system for conveying paper sheets drawn out from the first paper feeding unit 103 by the pickup roller 131. Further, the developing unit 104, the optical unit 105, the transfer unit 106 and the fixing unit 108 function as an image forming section for transferring an image onto the paper sheet conveyed through the medium conveyance system for image formation on the paper sheet. Still further, the paper discharge sensor 150 is located in the vicinity of a portion (discharging opening), from which the paper sheet is discharged from the printer body 101 toward the external (stacker 111), for detection of the passage of the paper sheet.

Moreover, referring to FIG. 6, a description will be taken hereinbelow of an arrangement of a control system of the printer 100 according to this embodiment.

As shown in FIG. 6, the first paper feeding unit 103 is composed of a paper size sensor 231, a paper feeding motor 232 and the paper feed sensor 233. As the paper size sensor 231, it is possible to use a sensor mentioned in, for example, Japanese Unexamined Patent Publication No. 64-87431 (Japanese Patent Application No. 62-243621). That is, in a manner that the system user sets the size of the paper sheets stored within the first paper feeding unit 103 through the use of a means provided in the first paper feeding unit 103, the paper size sensor 231 can detect the size of the paper sheets stored in the first paper feeding unit 103. Further, the paper feeding motor 232 is for rotationally driving the pickup roller 131 in the first paper feeding unit 103, while the paper feed sensor 233 is for detecting the paper sheet drawn out from the first paper feeding unit 103 as mentioned before.

Figure 7:
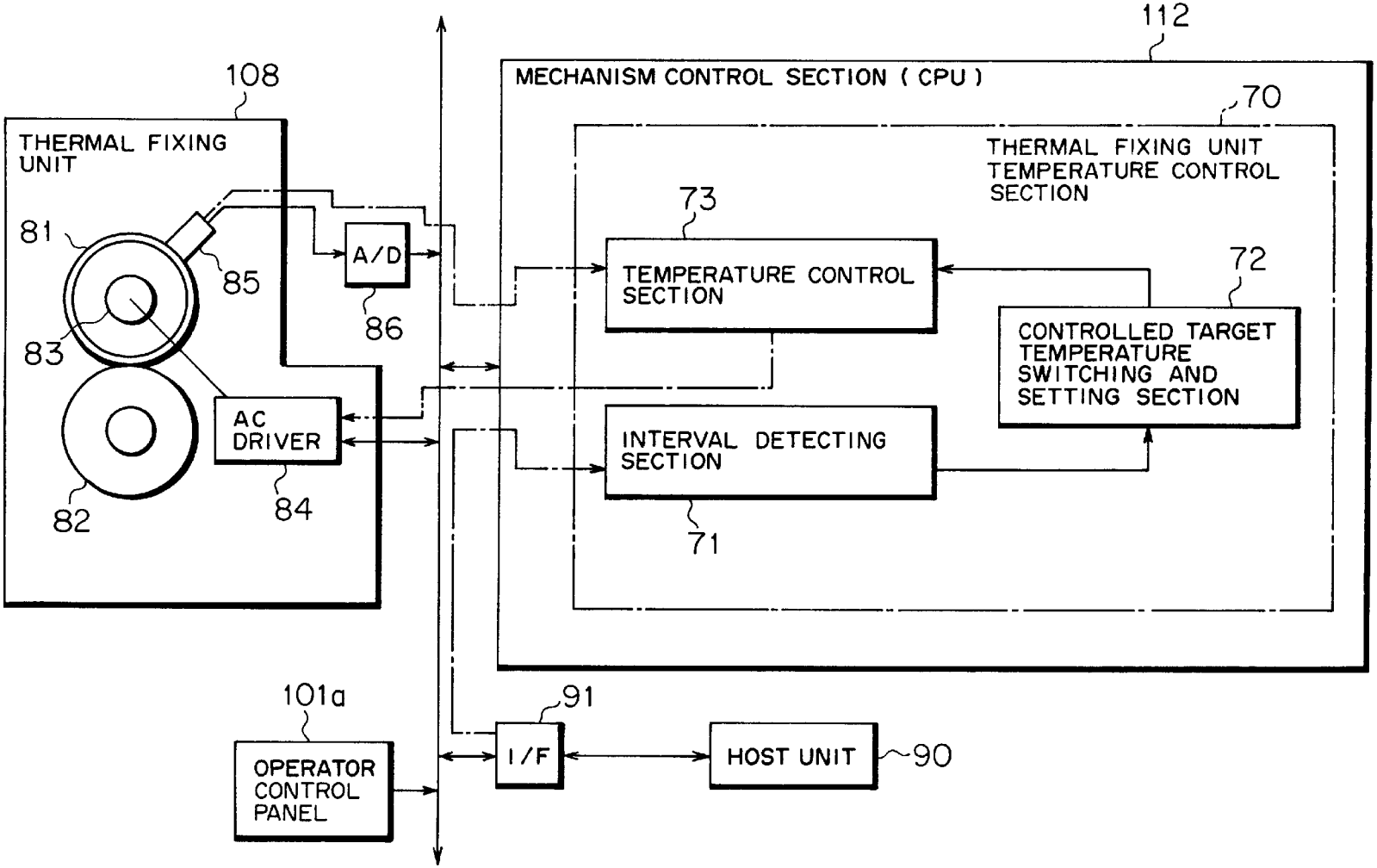
FIG. 7 is a block diagram showing a functional arrangement of a thermal fixing unit temperature control section (temperature control system) provided in the printer according to this embodiment.

Meanwhile, as shown in FIG. 7, the printer 100 according to this embodiment is connected through a network such as the LAN and a printer cable to a host unit 90 such as a personal computer, a word processor and a server, and is made to receive a video signal forming the print data together with a print control signal such as a print instruction from that host unit 90 through an I/F (interface) circuit 91. Further, its printer body 101 is, as shown in FIG. 6, composed of the aforesaid operator control panel 101a, controller 110, mechanism control section 112, power supply section 134, mentioned before, and a mechanism section 116.

The controller 110 is for the purpose of integrally managing the printer 100 according to this embodiment, that is, executes the control corresponding to an input from the operator control panel 101a and, further, fulfills a function to, when receiving a print request from the host unit 90, evolve print data coming together with the print instruction and supply it as video data to the mechanism control section 112.

The mechanism section 116 includes the developing unit 104, optical unit 105, transfer unit 106, fixing unit 108, resist sensor 117, paper passage sensor 119 and paper discharge sensor 150 mentioned previously with reference to FIG. 5, and further includes the conveying motor 107 (see FIG. 6) for rotationally driving the resist rollers 113. Although not shown in FIG. 6, in addition to the above-mentioned components, the mechanism 116 includes various types of mechanisms such as motors for driving the photosensitive drum 141 and the fixing unit 108.

The mechanism control section 112 controls the operations of the developing unit 104, the optical unit 105, the transfer unit 106, the conveying motor 107 and the thermal fixing unit 108 in the mechanism section 116 and the paper feeding motor 232 in the first paper feeding unit 103 on the basis of the detection results by the various types of sensors 117, 119, 231 and 233 in order to print video data coming from the controller 110 on paper sheets.

In fact, this mechanism control section 112 is realizable in a manner that a predetermined program runs on a CPU, and functions as an optical system control section 50, a motor control section 60 and a thermal fixing unit temperature control section 70. The optical system control section 50 controls the optical unit 105 to produce a latent image corresponding to video data on the photosensitive drum 141, and the motor control section 60 controls, in addition to the motors for driving the photosensitive drum 141, the heating roller 81 and others, the operations of the conveying motor 107 and the paper feeding motor 232. Further, the thermal fixing unit temperature control section 70 executes the lighting/lights-out control (ON/OFF control) for the heat source 83 within the heating roller 81 to bring the temperature of the thermal fixing unit 108 to a controlled target temperature, and this function of the thermal fixing unit temperature control section 70 constitutes a feature of this invention. The functional arrangement of the thermal fixing unit temperature control section 70 will be described herein later with reference to FIG. 7.

Furthermore, the mechanism control section 112 fulfills various functions as well as the above-mentioned functions of the control sections 50 to 70, and for example, when a print instruction occiirs, decides, on the basis of a detection signal from the paper size sensor 231 of the first paper feeding unit 103, whether or not the size of the paper sheets stored an the first paper feeding unit 103 coincides with the size of the paper sheet meeting the print instruction, and if coinciding with each other, makes the paper feeding motor 232 of the first paper feeding unit 3 operate. incidentally, in the case that the printer 100 is equipped with a plurality of paper feeding units and these paper feeding units store a plurality of types of paper sheets different in size from each other, the mechanism control section 112 selects the paper feeding unit accommodating the paper meeting a print instruction on the basis of a detection signal from the paper size sensor 233 in each of the paper feeding units, and then puts the paper feeding motor 232 of the paper feeding unit selected into operation.

The power supply section 134 plugs in an external AC power source so that the power supply spreads over all the portions within the printer 100, and particularly, supplies a high voltage to the developing unit 104 and the transfer unit 106 employing the corona discharge. Along with this, the power supply section 134 supplies power to the paper feeding motor 232 of the first paper feeding unit 103 and the conveying motor 107 within the printer body 101.

Referring to FIG. 7, a description will be made hereinbelow of a functional arrangement of the thermal fixing unit temperature control section 70 being characteristic of this invention.

In the printer 100 according to this embodiment, the thermal fixing unit 108 is composed of, in addition to the aforesaid heating roller 81 and pressure roller 82, an AC driver 84 for driving the heat source (halogen lamp) 83 and a temperature sensor (temperature detecting section) 85 such as a thermister for measuring the surface temperature of the heating roller 81 as the temperature of the thermal fixing unit 108. An analog temperature detection signal obtained by the temperature sensor 85 is converted through an A/D converter 86 into a digital signal which in turn, is inputted to the thermal fixing unit temperature control section 70 in the mechanism control section 112.

Furthermore, the mechanism control section (CPU) 112, functioning as the thermal fixing unit temperature control section 70, is connected through a bus to the operator control panel 101a and the thermal fixing unit 108, and further, is connected through a bus and the I/F circuit 91 to the host unit 90 for conducting the processing of print data from the host unit 90, the various motor control for the inter-paper interval management and the fixing temperature control through the use of a non-shown timer function.

Still further, the thermal fixing unit temperature control section 70 executes functions as an interval detecting section 71, a controlled target temperature switching and setting section 72 and a temperature control section 73.

The interval detecting section 71, when printing is consecutively made onto a plurality of paper without stopping the operation of the printer 100, detects an interval between the paper sheets (inter-paper distance), and detects that interval as an arrival time interval of print data (image formation data) coming from the controller 110.

The controlled target temperature switching and setting section 72 switches and sets a controlled target temperature for the thermal fixing unit 108 (that is, a desired value of the surface temperature of the heating roller 81 to be adjusted by the heat source 83) on the basis of the inter-paper distance detected by the interval detecting section 71.

Figure 8:
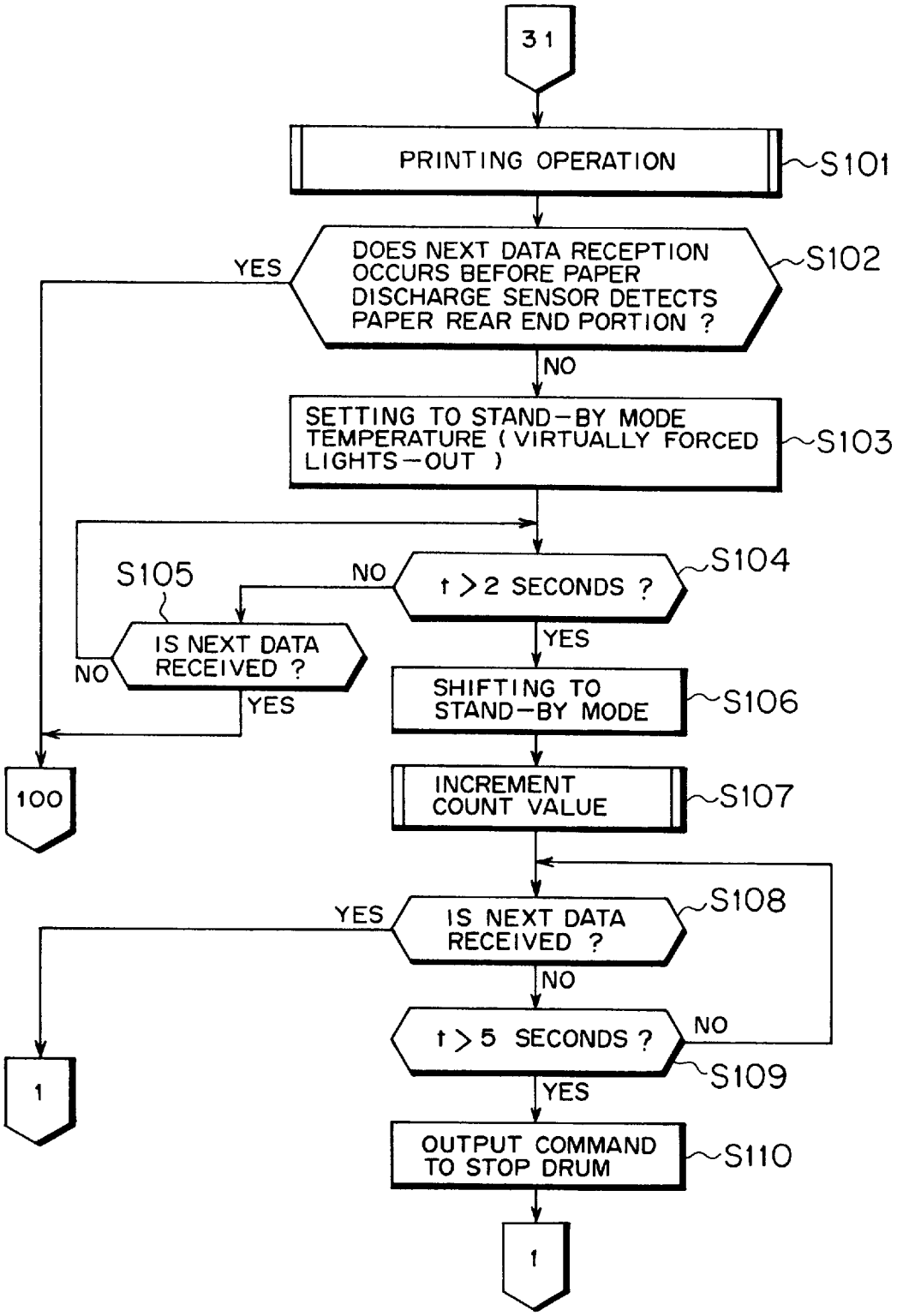
FIG. 8 is a flow chart useful for explaining an operation of the thermal fixing unit temperature control section in the printer according to this embodiment.

As will be described herein later with reference to FIG. 8. the controlled target temperature switching and setting section 72, when the inter-paper distance is greater than a predetermined value (that is, when the print data arrival time interval exceeds the time interval corresponding to the predetermined value), switches and sets the controlled target temperature for the thermal fixing unit 108 to a controlled target temperature for the start of printing lower than a controlled target temperature set in advance for consecutive printing.

Moreover, in this embodiment, as will be described herein later with reference to FIGS. 9 and 15, the controlled target temperature switching and setting section 72 has a function of switching among a stand-by mode controlled target temperature, a printing start controlled target temperature and a consecutive printing controlled target temperature in ascendance with the number of jobs processed after the start of the printer 100. In addition, in this embodiment, as will be described herein later with reference to FIGS. 11 to 14, the controlled target temperature switching and setting section 72 also has a function to switch the printing start controlled target temperature in accordance with the surface temperature of the heating roller 81 detected through the temperature sensor 85.

Besides, in this embodiment, the mechanism control section 112 is equipped with a job counter (not shown) which counts the aforesaid number of jobs as a job count value (which will be referred hereinafter to as a J.C).

The temperature control section 73 performs lighting/lights-out control of the heat source (halogen lamp) 83 based upon ON/OFF operations with a given duty ratio (for example, 60%) so that the detection result by the temperature sensor 85 reaches the controlled target temperature set by the controlled target temperature switching and setting section 72.

Subsequently, referring to FIG. 5, a description will be made hereinbelow of a basic operation of the printer 100 thus constructed according to this embodiment.

For printing on paper sheets in the printer 100, as shown in FIG. 5, the pickup roller 131 one by one draws out paper sheets accumulated in the first paper feeding unit 103. These paper sheets are conveyed upwardly in a state of being held by the feed roller 132 and further conveyed in a state of being held between the resist rollers 113 so that, in the transfer unit 106, a toner image created in the developing unit 104 is transferred onto the paper sheet. The paper sheet onto which the toner image is transferred is sent to the fixing unit 108 so that the toner image is fixed on the paper sheet by means of heat and pressure. Further, the paper sheet after the fixing is delivered through the first paper discharging roller 114 and the second paper discharging roller 115 to be discharged into the stacker 111 where the paper sheets are stored in a piled-up condition. The printing processing according to this embodiment forms an image a well-known image forming procedure exemplified by Japanese Unexamined Patent Publication No. 1-98529 (Japanese Patent Application No. 62-252524) and conducts the printing onto a paper sheet.

The mechanism control section 112 (see FIG. 6), as mentioned before, places the paper feeding motor 232 of the first paper feeding unit 103 into operation to rotationally drive the pickup roller 131 when the paper sheet meeting a print instruction is stored in the first paper feeding unit 103.

The pickup operation starts by operating the paper feeding motor 232 of the first paper feeding unit 103 to rotationally drive the pickup roller 131, and with the rotations of the pickup roller 131 and the feed roller 132 in the paper conveying direction, only one of the paper sheets stored in the first paper feeding unit 103 drawn out to be carried upwardly. A decision as to whether or not the paper sheet is drawn out from the first paper feeding unit 103 depends upon the detection result by the paper feed sensor 233. More specifically, if the paper feed sensor 233 does not detect the paper sheet although the pickup roller 131 rotates by a predetermined quantity, the mechanism control section 112 makes a decision to that the paper sheet is not normally drawn out, and once stops the paper drawing-out operation, thereafter again conducting the paper drawing-out operation. Further, if the paper feed sensor 233 detects the paper sheet before the pickup roller 131 rotates by the predetermined quantity, the mechanism control section 112 makes a decision to that the normal paper drawing-out takes place, and then continues the conveyance of the paper sheet.

Furthermore, after the resist sensor 117 detects the tip portion of the paper sheet conveyed by the pickup roller 131 and the feed roller 132, the paper conveyance continues by as quantity obtained in advance through an experiment and set. After rotating the paper feeding motor 232 by that set quantity to perform the further conveyance, the mechanism control section 112 stops the paper feeding motor 232. Whereupon, the completion of the pickup of the paper sheet from the first paper feeding unit 103 becomes possible in a state where the tip portion of the paper sheet is brought into contact with the resist rollers 113 to correct the oblique condition of the paper sheet.

Immediately after the stop of the paper feeding motor 232, the mechanism control section 112 operates the conveying motor 107 to rotationally drive the resist rollers 113 to start the paper conveyance.

Following this, a toner image formed on the surface of the photosensitive drum 141 is transferred onto the paper sheet in the transfer unit 106 while the paper sheet is conveyed by the resist rollers 113, and further, the paper sheet is conveyed by the resist rollers 113 into the fixing unit 108. In the fixing unit 108, the paper sheet is held between the heating roller 81 and the pressure roller 82 to be heated and pressurized so that the toner is softened to cause the toner image to be fixed on the paper sheet. The paper sheet undergoing the fixing processing in the fixing unit 108 is conveyed to put the flap gate 118 out of the way, and in the case of single-face printing, after passing by the flap gate 118, the paper sheet is sent by the first paper discharging roller 114 and the second paper discharging roller 115 and is discharged into the stacker 111 to be stored therein in a piled-up condition.

On the other hand, in the case of the double-face printing, after the printing onto the paper sheet is done as in the single-face printing operation, the paper sheet is conveyed by the paper discharging rollers 114, 115 until the rear end portion of the paper sheet arrives at the flap gate 118. The mechanism control section 112 conveys the paper sheer by a predetermined quantity (a value determined by actually conveying the paper sheet in an experimental stage) after the paper passage sensor 119 detects the rear end portion of the paper sheet and thereby recognizes that the rear end portion of the paper sheet passes by the flap gate 118. The mechanism control section 112 reversely drives the paper discharging rollers 114, 115 at the time of the recognition on the passage of the rear end portion of the paper sheet by the flap gate 118. The paper sheet conveyed in the opposite direction passes under the flap gate 118 and enters the double-face printing unit 102 to again run to the upstream side of the resist rollers 113 by the double-face feed rollers 121 and the double-face pickup roller 122. Thus, the printing operation similar to that for the single-face printing is conducted with respect to the paper sheet turned over, thus accomplishing the printing to the rear surface of the paper sheet. The paper sheet after the printing to its rear surface is likewise fixing-processed in the fixing unit 108, and then conveyed by the paper discharging rollers 114, 115 and discharged into the stacker 111 to be stored therein in a piled-up condition.

Referring now to the flow charts of FIGS. 8 to 15, a description will be made hereinbelow of the temperature control (a control operation by the thermal fixing unit temperature control section 70) for the thermal fixing unit 108 in the printer 100 according to this embodiment.

Figure 9:
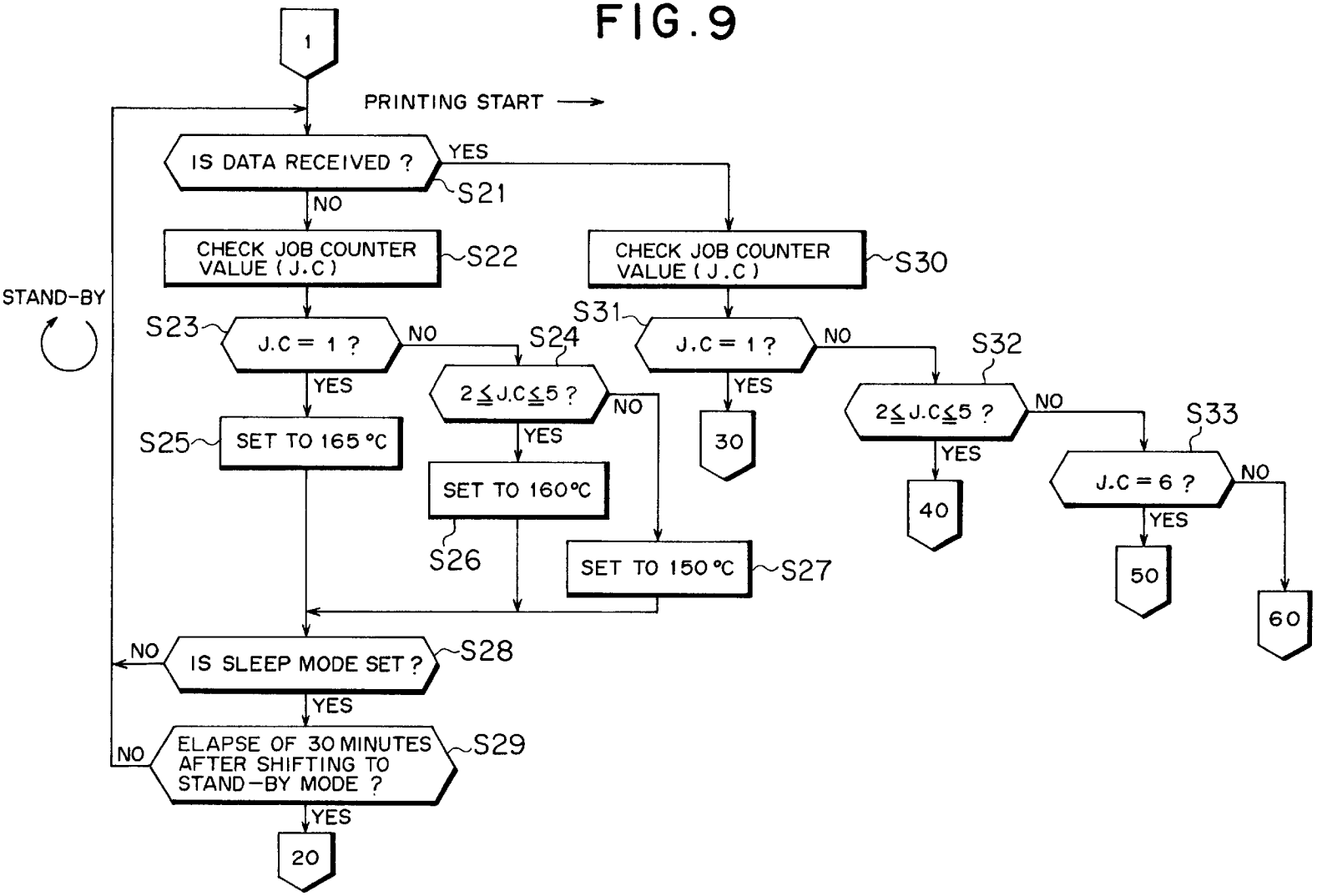
FIG. 9 is a flow chart available for explaining an operation of the printer in a stand-by mode and at a printing start according to this embodiment.

First, according to the flow chart (steps S21 to S33) of FIG. 9, the description will begins with operations of the printer 100 according to this embodiment to be taken in the stand-by mode and at the start of printing.

In the case of no reception of print data after a predetermined initializing operation (NO route from step S21), the printer 100 goes into a waiting condition (stand-by mode) for print data from the host unit 90 while the controlled target temperature switching and setting section 72 checks the value (J.C) of the job counter (steps S22 to S24) to set a stand-by mode controlled target temperature to that count value (steps S25 to S27).

For instance, in this embodiment, when J.C assumes 1 (YES route from step S23), the stand-by mode controlled target temperature is set as 165° C. (step S25), and when J.C is within the range of 2 to 5 (from step S23 through its NO route to YES route of step S24), the stand-by mode controlled target temperature is set as 160° C. (step S26), and further, when J.C is 6 or above (step S23 to NO route of step S25), the stand-by mode controlled target temperature is set as 150° C. (step S27).

Usually, in any case of the stand-by mode, the start of printing and the consecutive printing, as the value (J.C) of the job counter corresponding to the number of jobs processed after the start of the printer 100 is larger, the temperature of the pressure roller 82 accordingly rises. For this reason, in this embodiment, the controlled target temperature switching and setting section 72 is designed to set the controlled target temperature for the heating roller 81 at a lower value with the increase in the job counter value (J.C), thereby suppressing the tendency that the fixing excessively takes place.

Furthermore, during the stand-by mode, the printer 100 decides whether a sleep mode is set or not (step S28). If the sleep mode is not set (NO route of step S28), the operational flow returns to the step S21. The printer 100 waits for the reception of print data from the host unit 90. On the other hand, if the sleep mode is set (YES route from step S29), the printer 100 decides whether or not a predetermined time period (for example, 30 minutes) elapses after shifting into the stand-by mode (step S29). If the predetermined time period does not elapse (NO route from step S29), the operational flow returns to the step S21 to wait for the reception of print data from the host unit 90. In the case of the elapse of the predetermined time period (YES route from step S29), the printer 100 goes into the sleep mode.

Figure 10:
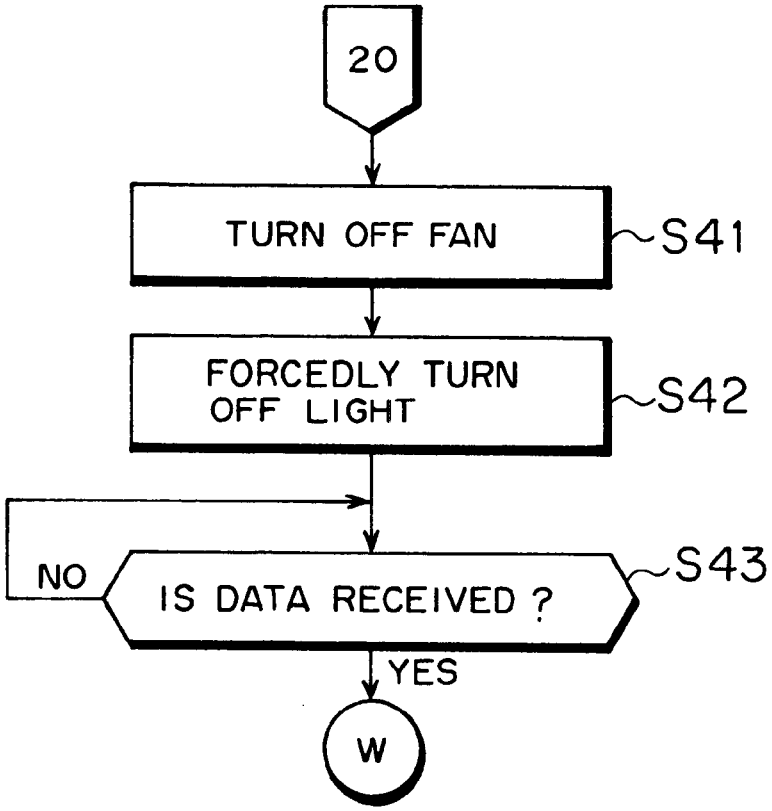
FIG. 10 is a flow chart available for describing an operation of the printer in a sleep mode according to this embodiment.

After going into the sleep mode, as shown in the flow chart (steps S41 to 43) of FIG. 10, the operation of a fan (not shown) within the printer 100 stops (step S41), the heat source (halogen lamp) 83 of the thermal fixing unit 108 is forcedly turned off (step S42), and then, the printer 100 waits for the reception of print data from the host unit 90 (step S43). If the printer 100 receives print data from the host unit 90 when being in this sleep mode (YES route from step S43), the operation of the printer 100 enters the operational flow of FIG. 9 after a predetermined starting processing.

Meanwhile, when receiving print data from the host unit 90 during the stand-by mode (or the sleep mode) (YES route from step S21), the controlled target temperature switching and setting section 72 checks the job count value (J.C) (steps S30 to S33) conducts a processing flow to set the printing start controlled target temperature [controlled target temperature for the first page printing (printing at the start of printing) to be taken for when a print instruction arrives during the stand-by mode and the printing starts] to the job count value (J.C).

Figure 11:
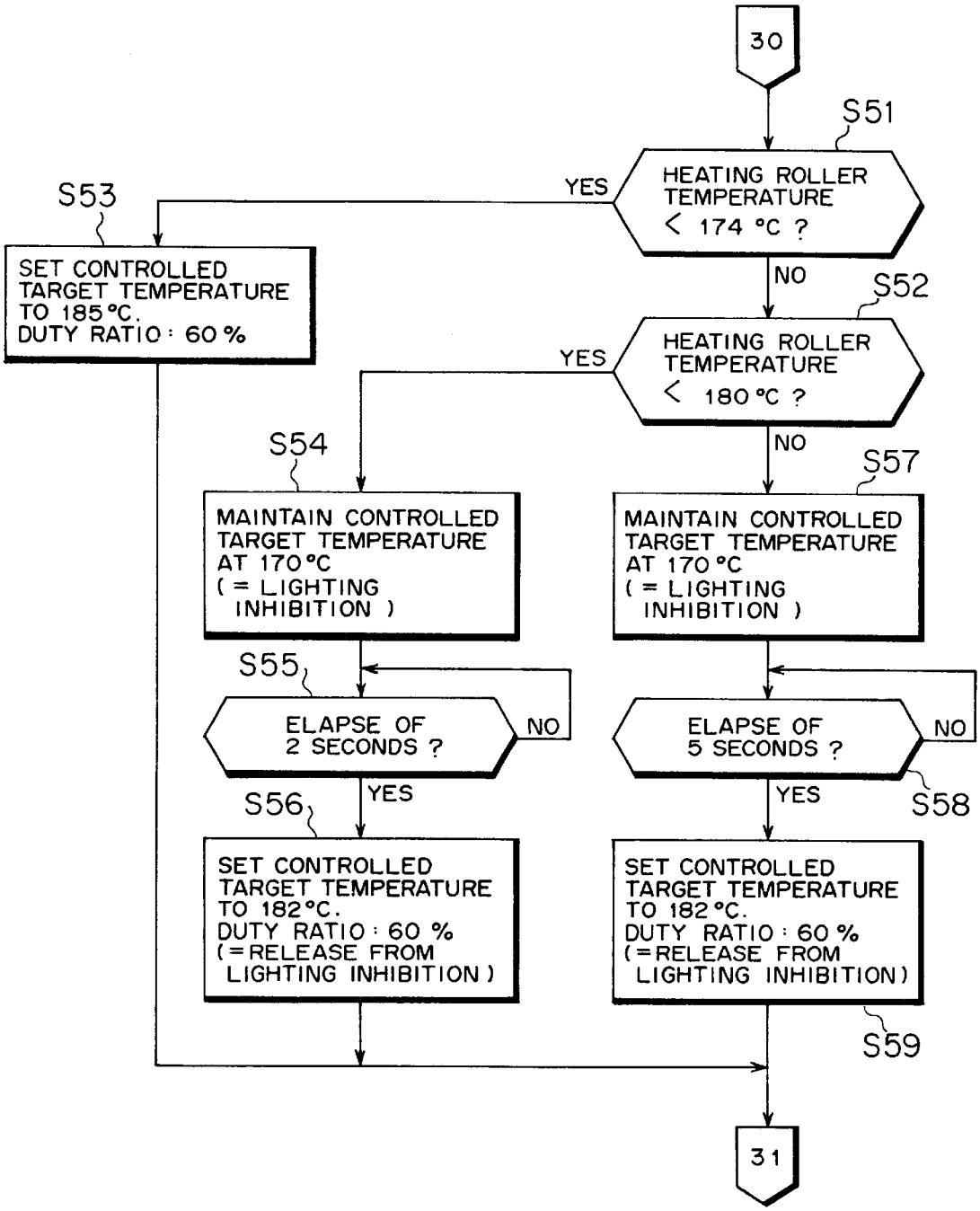
FIG. 11 is a flow chart useful for describing an operation of the printer at a printing start according to this embodiment.
Figure 12:
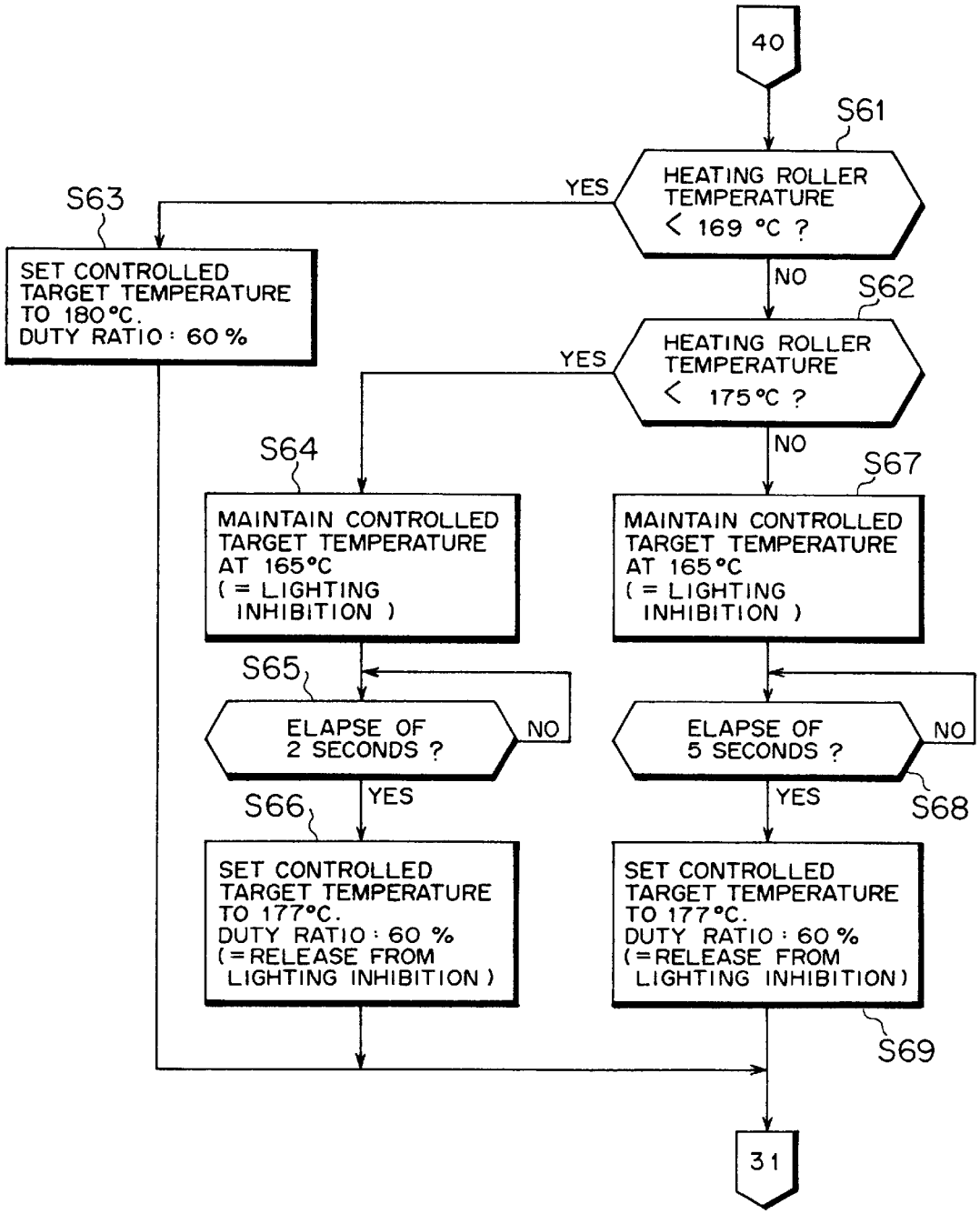
FIG. 12 is a flow chart useful for describing an operation of the printer at a print start according to this embodiment.
Figure 13:
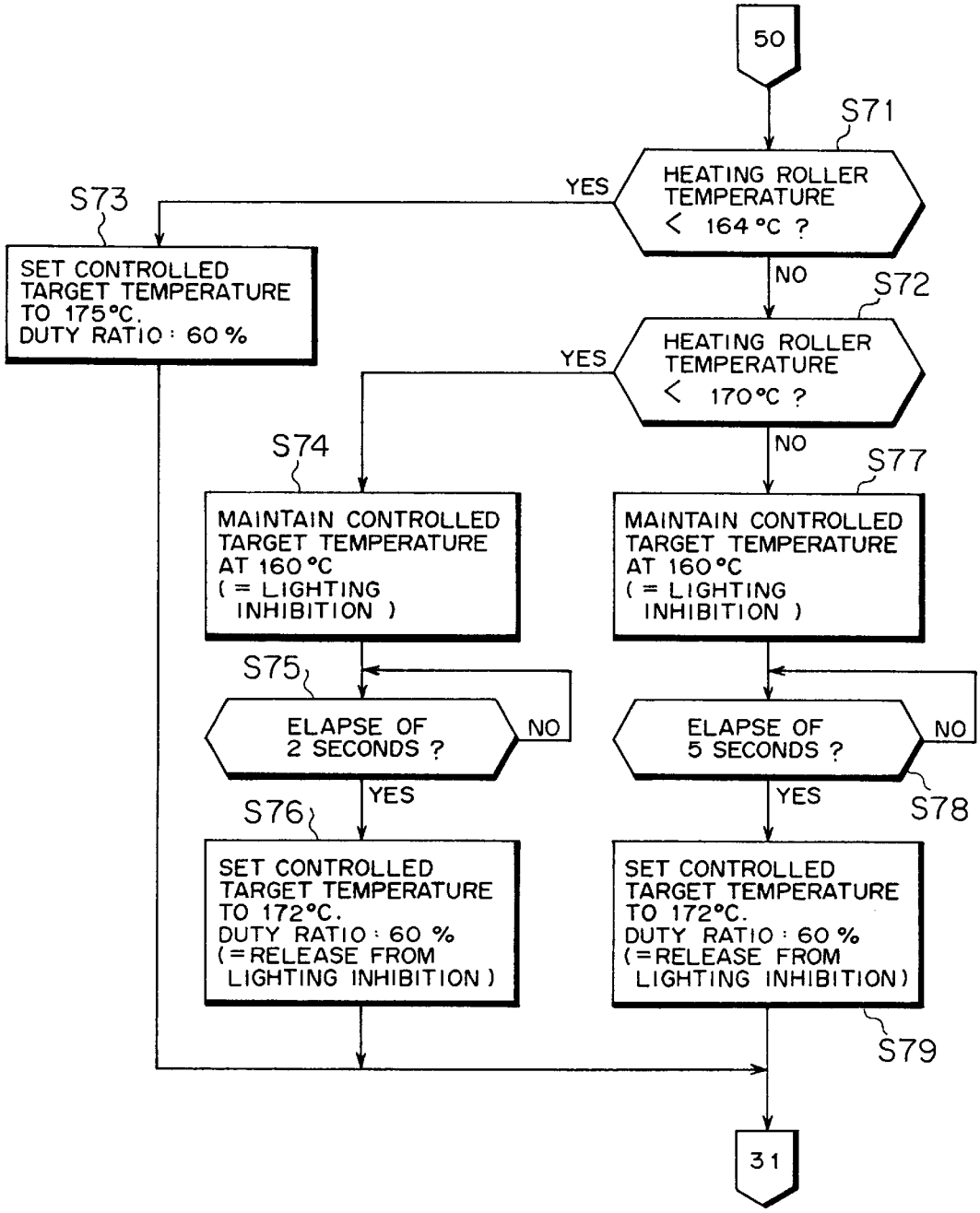
FIG. 13 is a flow chart useful for explaining an operation of the printer at a printing start according to this embodiment.

For example, in this embodiment, when J.C assumes 1 (YES route from step S31), the processing of the controlled target temperature switching and setting section 72 proceeds to the operational flow (steps S51 to S59) of FIG. 11. When J.C is within the range of 2 to 5 (from step S31 through its NO route to YES route of step S32), the processing enters the operational flow (steps S61 to S69) of FIG. 12. Further, when J.C assumes 6 (from steps S31, S32 through their NO routes to YES route of step S33), the processing goes into the operational flow (steps S71 to S79) of FIG. 13. Still further, when J.C is 7 or above (NO routes of steps S31 to S33), the processing advances to the operational flow (steps S81 to S89) of FIG. 14.

When J.C =1, as shown in FIG. 11, the controlled target temperature switching and setting section 72 sets the pTinting start controlled target temperature in accordance with the surface temperature of the heating roller 81 detected through the temperature sensor 85.

More specifically, when the heating roller 81 temperature is lower than 174° C. (YES route of step S51), the controlled target temperature switching and setting section 72 sets the controlled target temperature at 185° C., and the temperature control section 73 ON/OFF-controls the heat source (halogen lamp) 83 in a duty ratio of 60% so that the surface temperature of the heating roller 81 reaches 185° C. (step S53).

Furthermore, when the heating roller 81 temperature is equal to or more than 174° C. but less than 180° C. (from step S51 through its NO route to YES route of step S52), the controlled target temperature switching and setting section 72 maintains the controlled target temperature to 170° C. for 2 seconds (steps S54, S55; virtually, the inhibition of lighting for 2 seconds), and then, sets the controlled target temperature to 182° C., while the temperature control section 73 ON/OFF-controls the heat source (halogen lamp) 83 in a duty ratio of 60% so that the surface temperature of the heating roller 81 reaches 182° C. (step S56).

Still further, when the heating roller 81 temperature is equal to or more than 180° C. (NO routes of steps S51, S52), the controlled target temperature switching and setting section 72 maintains the controlled target temperature to 170° C. for 5 seconds (steps S57, S58; virtually, the inhibition of lighting for 5 seconds), and then sets the controlled target temperature to 182° C., while the temperature control section 73 ON/OFF-controls the heat source (halogen lamp) 83 in a duty ratio of 60% so that the surface temperature of the heating roller 81 becomes 182° C.

Figure 14:
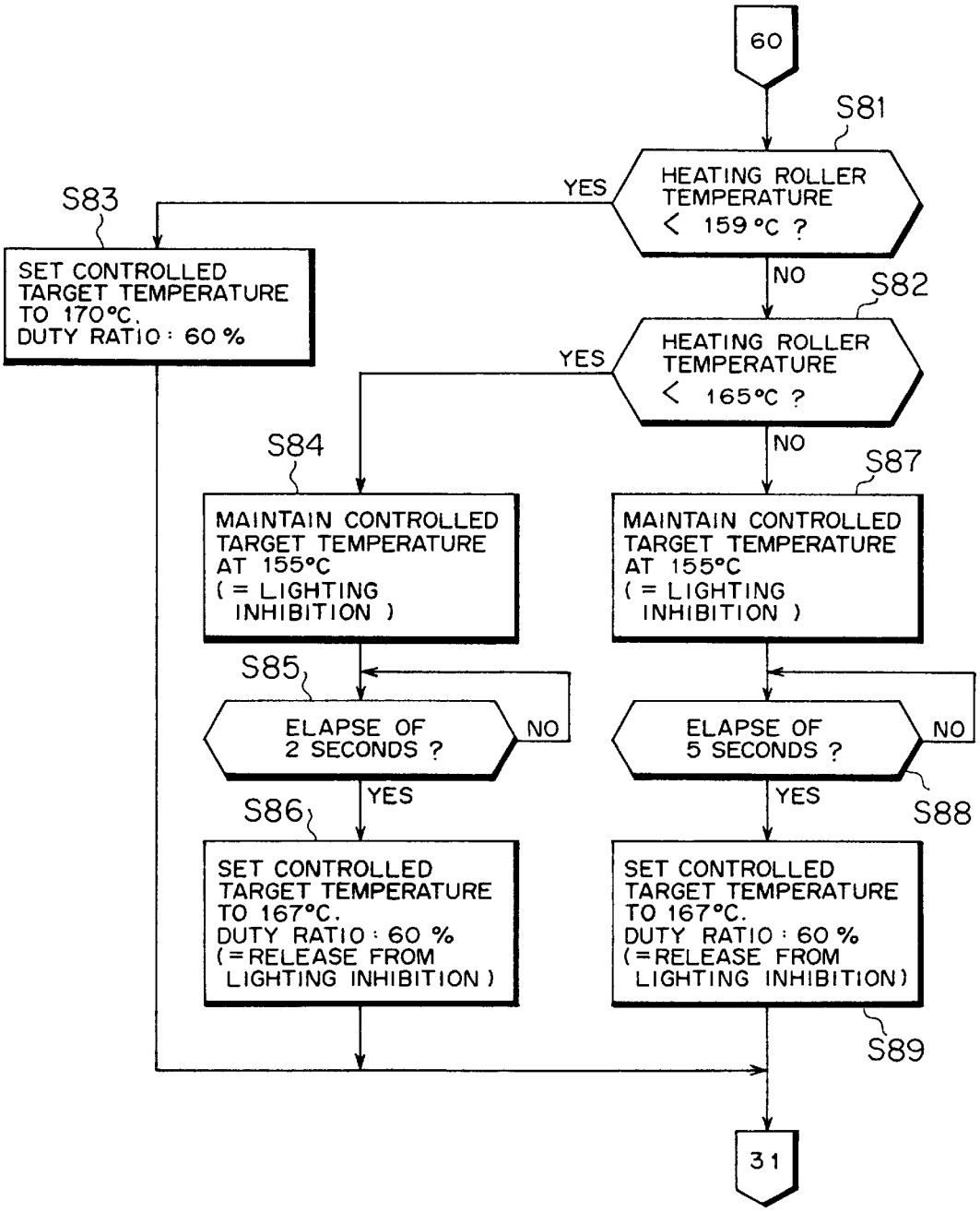
FIG. 14 is a flow chart useful for explaining an operation of the printer at a printing start according to this embodiment.

In this control, since the operational flow (steps S61 to S69 in FIG. 12) to be taken for when J.C =2 to 5, the operational flow (steps S71 to S79 in FIG. 13) to be executed for when J.C =6 and the operational flow (steps S81 to S89) in FIG. 14) to be implemented for when J.C =7 or more arc similar to the operational flow (steps S51 to S59 in FIG. 11) for J.C =1, the description thereof will be omitted for brevity.

However, in these operational flows, the comparative temperature with (reference temperature for) the heating roller temperature and the printing start controlled target temperature are set to be lower with an increase in the J.C value. Concretely, when J.C =2 to 5, the comparative temperature with the heating roller temperature is set to be 169° C. and 175° C. while the printing start controlled target temperature is set to be 180° C., 165° C. and 177° C. Further, when J.C =6, the comparative temperature with the heating roller temperature is set to be 164° C. and 170° C. while the printing start controlled target temperature is set as 175° C., 160° C. and 172° C. Still further, when J.C <7 or more, the comparative temperature with the heating roller temperature is set as 159° C. and 165° C. while the printing start controlled target temperature is set as 170° C., 155° C. and 167° C.

After the printing start controlled target temperature is set as mentioned above, the printing operation (step S101) in FIG. 8 starts. On the completion of the printing operation, in accordance with the optical flow (steps S102 to S110) of FIG. 8, the controlled target temperature switching and setting section 72 decides whether or not the printing is done in succession, and switches and sets the controlled target temperature.

Figure 15:
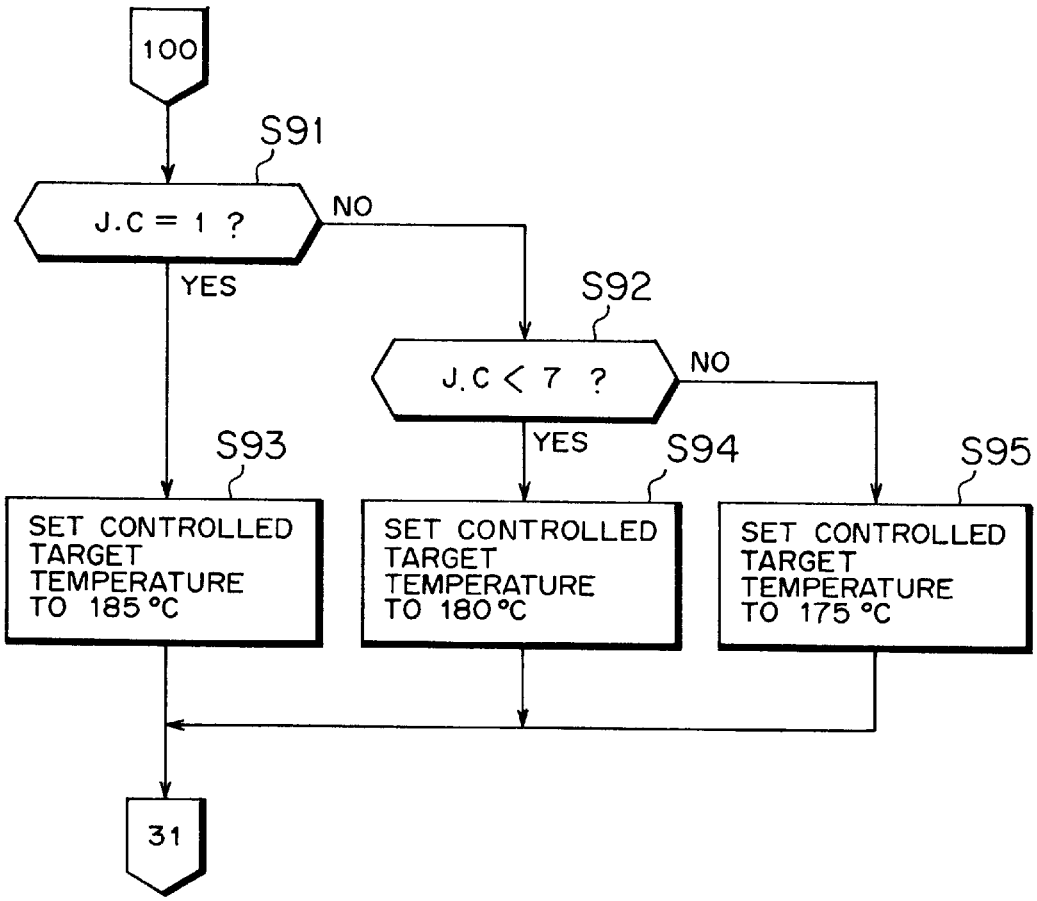
FIG. 15 is a flow chart available for describing an operation of the printer at a consecutive printing according to this embodiment.
Figure 16:
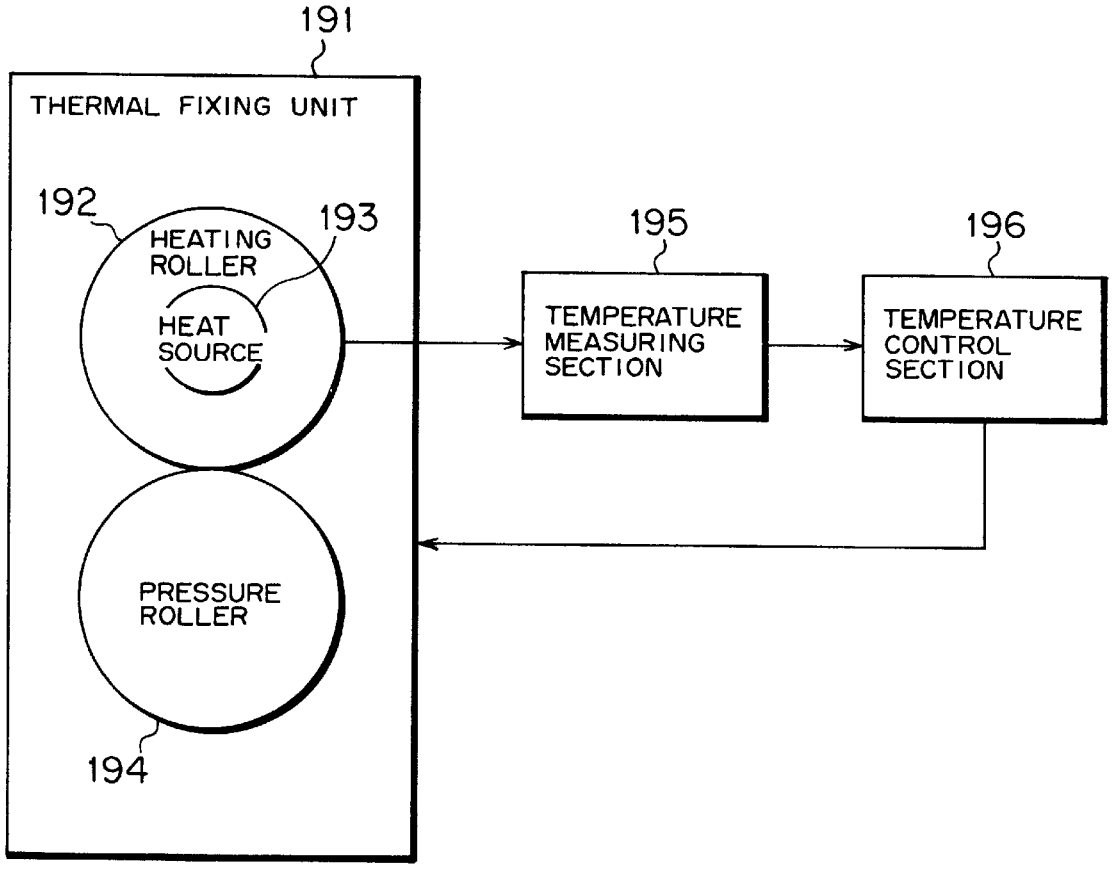
FIG. 16 RELATED ART
FIG. 16 is a block diagram showing a common construction and temperature control system of a thermal fixing unit.
Figure 17:
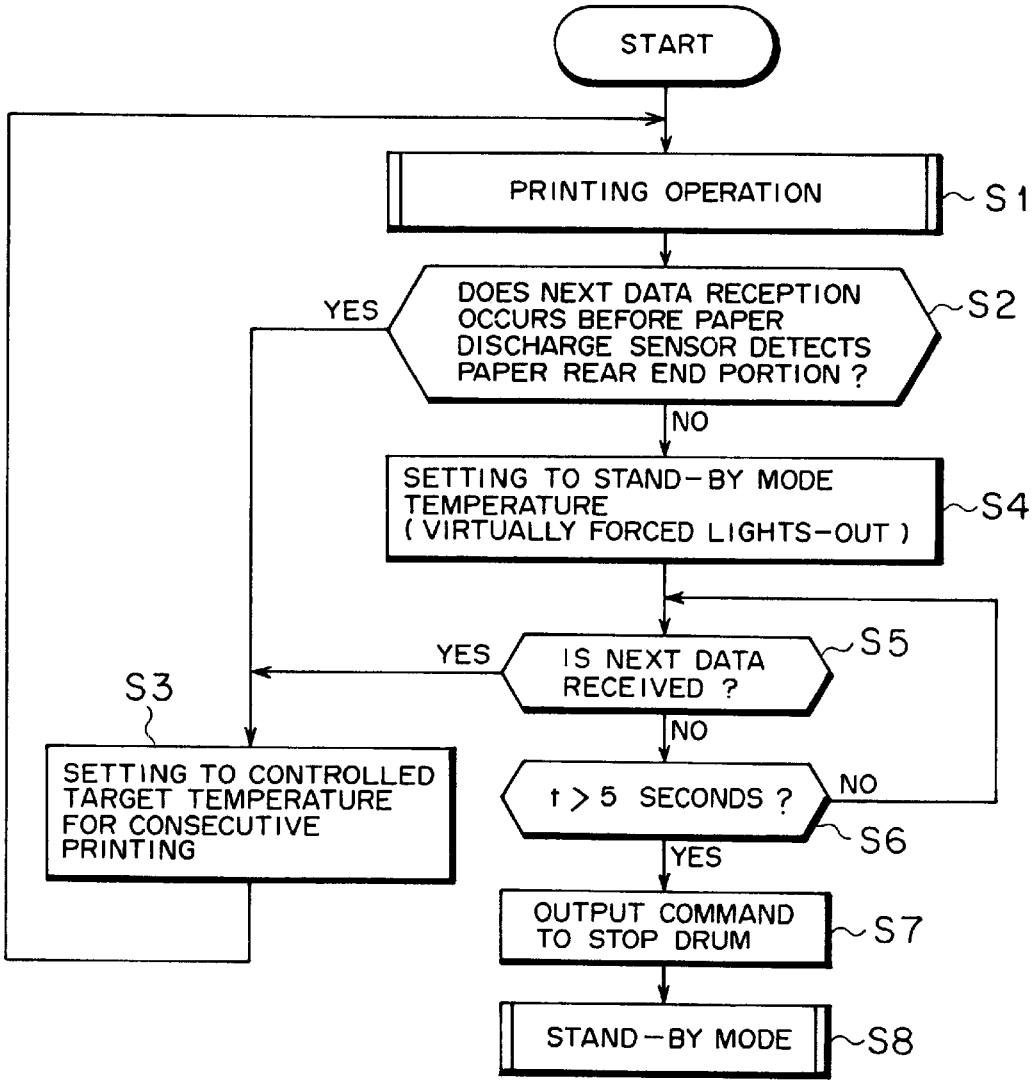
FIG. 17 PRIOR ART
FIG. 17 is a flow chart for describing a prior control operation of a printer including a thermal fixing unit.
Figure 18A:
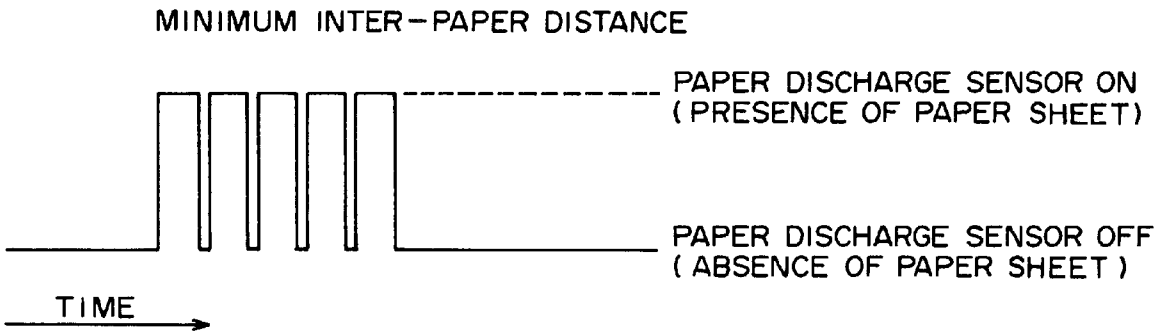
FIG. 18A is an illustration of an output of a paper discharge sensor to be taken when a consecutive printing is conducted in a state where paper sheets are fed at a maximum print speed and at a minimum interval between paper sheets.
Figure 18B:
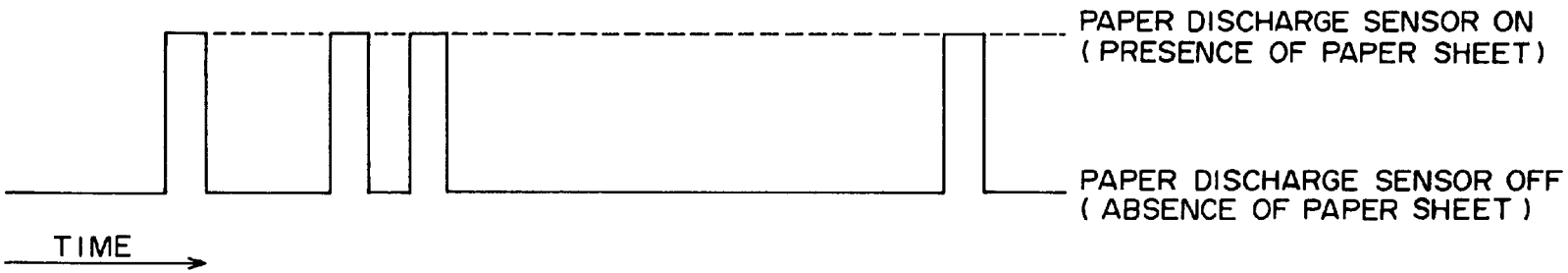
FIG. 18B is an illustration of an output of a paper discharge sensor to be taken when a consecutive printing is done in a state where the interval between paper sheets varies.

After the completion of the printing operation (step S101) of print data from the host unit 90, when successively receiving print data from the contToller 110 before the paper discharge sensor (not shown) of the thermal fixing unit 108 detects the rear end portion of the paper sheet (YES route of step S102), the controlled target temperature switching and setting section 72 implements the operational flow of FIG. 15 to set a controlled target temperature for the consecutive printing.

On the other hand, after the completion of printing, if not receiving print data from the controller 110 before the paper discharge sensor 150 detects the paper rear end portion (NO route of step S102), the controlled target temperature switching and setting section 72 sets the controlled target temperature for the heating roller 81 to the stand-by mode controlled target temperature, and the temperature control section 73 virtually forcedly turns off the heat source (halogen lamp) 83 (step S103). Besides, in the step S103, in order to prevent the pressure roller 82 from being excessively heated by the contact with the heating roller 81, the controlled target temperature for the heating roller 81 is merely set to the stand-by mode controlled target temperature below the regular printing controlled target temperature, that is, the processing does not actually go into the stand-by mode.

Moreover, the controlled target temperature switching and setting section 72 monitors the elapsed time after the completion of the last reception of the print data from the controller 110 and, when receiving the next print data from the controller 110 (YES route of step S105) before the elapsed time exceeds 2 seconds (NO route of step S104), implements the operational flow of FIG. 15 to set the controlled target temperature for the consecutive printing.

Referring to the operational flow (steps S91 to S95) of FIG. 15, a description will be given hereinbelow of a setting procedure of the consecutive printing controlled target temperature in the controlled target temperature switching and setting section 72. The controlled target temperature switching and setting section 72 checks the job count value (J.C) (steps S91, S92). and sets the printing start controlled target temperature in accordance with that job count value (steps S93 to S95).

For instance, in this embodiment, when J.C is at 1 (YES route of step S91), the consecutive printing controlled target temperature is set to be 185° C. (step S93), and, when J.C is within the range of 2 to 6 (from step S91 through its NO route to YES route of step S92, the consecutive printing controlled target temperature is set to be 180° C. (step S94), and further, when J.C is 7 or above, the consecutive printing controlled target temperature is set to be 175° C. (step S95). Incidentally, usually, due to the situation mentioned previously, the consecutive printing controlled target temperature is set to be higher than the printing start controlled target temperature.

Meanwhile, when not receiving the next print data from the controller 110 although the aforesaid elapsed time exceeds 2 seconds (YES route of step S104), the controlled target temperature switching and setting section 72 establishes the stand-by mode (step S106), and increments the job counter value (step S107).

Thereafter, the controlled target temperature switching and setting section 72 monitors the reception of the next print data from the controller 110 before the elapsed time exceeds 5 seconds (steps S108, S109).

When receiving the next print data from the controller 110 when the elapsed time is between 2 seconds and 5 seconds (NO route of step S109 and YES route of step S108), the controlled target temperature switching and setting section 72 conducts the operational flow of FIG. 9 to set the controlled target temperature for the thermal fixing unit 108 to the printing start controlled target temperature lower than the consecutive printing controlled target temperature. Further, if the elapsed time exceeds 5 seconds (YES route of step S109), the controlled target temperature switching and setting section 72 executes the operational flow of FIG. 9 to maintain the stand-by more.

In the above-described printer 100 (the method of controlling the temperature of the thermal fixing unit 108) according to the embodiment of this invention, in the case of making the consecutive printing in which the inter-paper distance is longer by a predetermined value or more than the minimum distance due to the print data evolution time, the controlled target temperature switching and setting section 72 of the mechanism control section 112 detects the delay of the arrival time of the print data and switches the controlled target temperature for the heating roller 81 of the thermal fixing unit 108 in a direction of weakening the fixing.

That is, in this embodiment, unlike the prior technique, the controlled target temperature for the thermal fixing unit 108 is switched on the basis of the print data arrival time (i.e., inter-paper distance).

In more detail, as mentioned before, if the next print data arrives from the controller 110 within 2 seconds after the end of the printing, the temperature rise of the pressure roller 82 is not great enough to create a problem, and therefore, the controlled target temperature for the next printing is set to the consecutive printing controlled target temperature.

On the other hand, if the next print data arrives from the controller 110 in a period between 2 seconds and 5 seconds after the printing completion, since the temperature of the pressure roller 82 greatly rises, the controlled target temperature for the next printing is set to the printing start controlled target temperature.

In a manner that the controlled target temperature for the thermal fixing unit 108 is switched in accordance with the variation in the print data arrival time interval, i.e., the variation in the inter-paper distance as described above, even if the interval between the paper sheets within the printer 100 greatly varies, it is possible to certainly suppress the occurrence of excessive fixing resulting from the event that the pressure roller 82 is excessively heated by the heating roller 81. Accordingly, it is possible to maintain the balance between the fixing rate and the occurrence of wrinkles, thus surely preventing the occurrence of wrinkles on the paper sheets after the fixing.

Particularly, although, with the recent progress of OA, there is a more tendency for the print data evolution time to greatly vary because various types of data exist in a mixed condition on one page, as mentioned before, the printer 100 according to this embodiment can surely prevent the occurrence of wrinkles on paper sheets after fixing and remarkably improve the print quality even if the print data evolution time greatly varies, that is, the inter-paper distance largely varies within the printer 100.

In addition, even in the case of the use under an environment in which a plurality of users make a request, to printers connected to a network, for various kinds of printing processing at an arbitrary time, the printer 100 according to this embodiment can achieve the thermal fixing while maintaining the print quality without causing the decrease in throughput, thus sharply improving the performance of an information processing system.

Moreover, in this embodiment, in the case that the inter-paper distance (print data arrival time interval) is prolonged, the printing start controlled target temperature already set is used as the controlled target temperature for the thermal fixing unit 108, and therefore, there is no need to separately set a controlled target temperature to be taken for when the inter-paper distance varies.

Besides, in this embodiment, the inter-paper distance is detected as the arrival time interval of print data sent from the controller 110 to the mechanism control section 112, and hence, the detection of the inter-paper distance becomes easy without physically measuring the inter-paper distance.

It should be understood that the present invention is not limited to the above-described embodiment, and that it is intended to cover all changes and modifications of the embodiments of the invention herein which do not constitute departures from the spirit and scope of the invention.

For instance, in the above description of this embodiment, although the image forming apparatus is taken as an electrophotographic printer (laser printer or the like), this invention is not limited to this, but as long as an image forming apparatus is equipped with a thermal fixing unit, this invention is also applicable thereto as well as the above-described embodiment, and in this case, the same effects are obtainable.

What is claimed is:

1. A thermal-fixing-unit temperature control method for an image forming apparatus which includes (a) an interim-image forming section for forming a succession of interim images one at a time onto each of successive record mediums based on a plurality of items of input image data representing various object images, the successive record mediums being fed one after another with staggered timing intervals, and (b) a thermal fixing unit, disposed downstream of the interim-image forming section, for receiving from the interim-image forming section the successive record mediums one at a time and fixing the interim image formed on the individual record medium, the thermal fixing unit including a heat roller, in which a heat source is mounted, and a pressure roller coating with the heat roller for feeding the individual record medium while the interim image is fixed to the individual record medium under heat originated from the heat source, said method being operable to control a temperature of the thermal fixing unit and comprising the steps of:

(I) detecting the intervals of feeding of the individual record mediums one interval after another;

(II) counting how many image forming jobs have been carried out by the image forming apparatus from start-up of the image forming apparatus by incrementing a count of image forming jobs for every individual interval which is longer than a predetermined value, each of which jobs is composed of one or more individual-image formings sequentially performed without any intervals longer than the predetermined value;

(III) setting a target temperature of the thermal fixing unit based on the then-current total number of image forming jobs counted in said step (II) and the then-current interval detected in said step (I);

(IV) detecting a then-current temperature of the thermal fixing unit; and (V) controlling the thermal intensity of the heat source so as to adjust the temperature of the thermal fixing unit to the target temperature set in said step (III) using the then-current temperature detected in said step (IV).

2. A thermal-fixing-unit temperature control method as defined in claim 1, wherein, when the then-current interval is larger than a predetermined value, the target temperature of said thermal fixing unit is set in said step (III) to be lower than a predetermined target temperature for a successive image formation.

3. A thermal-fixing-unit temperature control method as defined in claim 2, wherein the target temperature to be set in said step (III) when the then-current interval is larger than the predetermined value is a predetermined target temperature for the start-up of the image foming apparatus.

4. A thermal-fixing-unit temperature control method as defined in claim 3, wherein the intervals of feeding of the individual record mediums are detected in said step (II) in terms of the intervals of arriving of the individual input image data to a mechanism control section in the image formation apparatus, and when the then-current interval of arriving of the individual input image data exceeds a time corresponding to the predetermined value for the interval of feeding, the then-current interval of feeding of the individual record medium interval is judged in said step (III) to be larger than the predetermined value.

5. A thermal-fixing-unit temperature control method as defined in claim 2, wherein the intervals of feeding of the individual record mediums are detected in said step (II) in terms of the intervals of arriving of the individual input image data to a mechanism control section in the image formation apparatus, and when the then-current interval of arriving of the individual input image data exceeds a time corresponding to the predetermined value for the interval of feeding, the then-current interval of feeding of the individual record medium is judged in said step (III) to be larger than the predetermined value.

6. A thermal-fixing-unit temperature control system in an image forming apparatus which includes (a) an interim-image forming section for forming a succession of interim images one at a time onto each of successive record mediums based on a plurality of items of input image data representing various object images, the successive record mediums being fed one after another with staggered timing intervals, and (b) a thennal fixing unit, disposed downstream of the interim-image forming section, for receiving from the interim-image forming section the successive record mediums one at a time and fixing the interim image formed on the individual record medium, the thermal fixing unit including a heat roller, in which a heat source is mounted, and a pressure roller coating with the heat roller for feeding the individual record medium while the interim image is fixed to the individual record medium under heat originated from the heat source, said system being operable to control a temperature of the thermal fixing unit and comprising:

(I) an interval detecting section for detecting the intervals of feeding of the individual record mediums one interval after another;

(II) a job counting section for counting how many image forming apparatus from start-up of the image forming apparatus by incrementing a count of image forming jobs for every individual interval which is longer than a predetermined value, each of which jobs is composed of one or more individual-image formings sequentially performed without any intervals longer than the predetermined value;

(III) a target-temperature setting section for setting a target temperature of the thermal fixing unit based on the then-current total number of image forming jobs counted by said job counting section and the then-current interval detected by said interval detecting section;

(IV) a temperature detecting section for detecting a then-current temperature of the thermal fixing unit; and (V) a temperature control section, operatively connected to the heat source, for controlling the thermal intensity of the heat source so as to adjust a temperature of the thermal fixing unit to the target temperature set by said target-temperature setting section using the then-current temperature detected by said temperature detecting section.

7. A thermal-fixing-unit temperature control system as defined in claim 6, wherein, when the then-current interval is larger than a predetermined value, said target-temperature setting section is operable to set the target temperature of said thermal fixing unit to a value lower than a predetermined target temperature for a successive image formation.

8. A thermal-fixing-unit temperature control system as defined in the claim 7, wherein the target temperature to be set by said target-temperature setting section when said record medium interval is larger than the predetermined value is a predetermined target temperature for the start-up of the image forming apparatus.

9. A thermal-fixing-unit temperature control system as defined in claim 8, wherein said interval detecting section is operable to detect the intervals of feeding of the individual record mediums in terms of the intervals of arriving of the individual input image data to a mechanism control section in the image forming apparatus, and said target-temperature setting section is operable to judge, when the then-current interval of arriving of the individual input image data detected by said interval detecting section exceeds a time corresponding to the predetermined value for the interval of feeding, that the then-current interval of feeding of the individual record medium becomes larger than the predetermined value.

10. A thermal-fixing-unit temperature control system as defined in claim 7, wherein said interval detecting section is operable to detect the intervals of feeding of the individual record mediums in terms of the intervals of arriving of the individual input image data to a mechanism control section in the image forming apparatus, and said target-temperature setting section is operable to judge, when the then-current interval of arriving of the individual input image data detected by said interval detecting section exceeds a time corresponding to the predetermined value for the interval of feeding, that the then-current interval of feeding of the individual record medium becomes larger than the predetermined value.

11. An image forming apparatus comprising:

(A) an interim-image forming section for forming a succession of interim images one at a time onto each of successive record mediums based on a plurality of items of input image data representing various object images, the successive record mediums being fed one after another with staggered timing intervals;

(B) a thermal fixing section, disposed downstream of said interim-image forming section, for receiving from said interim-image forming section the successive record mediums one at a time and fixing the interim image formed on the individual record medium, said thermal fixing section including a heat roller, in which a heat source is mounted, and a pressure roller coacting with said heat roller for feeding the individual record medium while the interim image is fixed to the individual record medium under heat originated from the heat source;

(C) an interval detecting section for detecting the intervals of feeding of the individual record mediums one interval after another;

(D) ajob counting secfion for counting how many image forming jobs have been carried out by said image forming apparatus from start-up of said image forming apparatus by incrementing a count of image forming jobs for every individual interval which is longer than a predetermined value, each of which jobs is composed of one or more individual-image formings sequentially performed without any intervals longer than the predetermined value;

(E) a target-temperature setting section for setting a target temperature of said thermal fixing unit based on the then-current total number of image forming jobs counted by said job counting section and the then-current interval detected by said interval detecting section;

(F) a temperature detecting section for detecting a then-current temperawre of said thermal fixing unit; and (G) a temperature control section, operatively connected to said heat source, for controlling the thermal intensity of said heat source so as to adjust a temperature of said thermal fixing unit to the target temperature set by said target-temperature setting section using the then-current temperature detected by said temperature detecting section.

12. An image forming apparatus as defined in claim 11, wherein, when the then-current interval is larger than a predetermined value, said target-temperature setting section is operable to set the target temperature of said thermal fixing unit to a value lower than a predetermined target temperature for a successive image formation.

13. An image forming apparatus as defined in claim 12, wherein the target temperature to be set by said target-temperature setting section when said record medium interval is larger than the predetermined value is a predetermined target temperature for the start-up of said image forming apparatus.

14. An image forming apparatus as defined in claim 13, wherein said interval detecting section is operable to detect the intervals of feeding of the individual record mediums in terms of the intervals of arriving of the individual input image data to a mechanism control section in said image forming apparatus, and said target-temperature setting section is operable to judge, when the then-current interval of arriving of the individual input image data detected by said interval detecting section exceeds a time corresponding to the predetermined value for the interval of feeding, that the then-current interval of feeding of the individual record medium becomes larger than the predetermined value.

15. An image forming apparatus as defined in claim 12, wherein said interval detecting section is operable to detect the intervals of feeding of the individual record mediums in terms of the intervals of arriving of the individual input image data to a mechanism control section in said image forming apparatus, and said target-temperature setting section is operable to judge, when the then-current interval of arriving of the individual input image data detected by said interval detecting section exceeds a time corresponding to the predetermined value for the interval of feeding, that the then-current interval of feeding of the individual record medium becomes larger than the predetermined value.

* * * * *